US009099817B2

(12) United States Patent
Kondo et al.

(10) Patent No.: US 9,099,817 B2
(45) Date of Patent: Aug. 4, 2015

(54) WATERPROOF CONNECTOR

(71) Applicant: FUJIKURA LTD., Kotoh-ku, Tokyo (JP)

(72) Inventors: Masahiro Kondo, Sakura (JP); Yasuo Takemura, Sakura (JP)

(73) Assignee: FUJIKURA LTD., Tokyo (JP)

( * ) Notice: Subject to any disclaimer, the term of this patent is extended or adjusted under 35 U.S.C. 154(b) by 34 days.

(21) Appl. No.: 13/631,350

(22) Filed: Sep. 28, 2012

(65) Prior Publication Data

US 2013/0023140 A1 Jan. 24, 2013

Related U.S. Application Data

(63) Continuation of application No. PCT/JP2011/058028, filed on Mar. 30, 2011.

(30) Foreign Application Priority Data

Mar. 31, 2010 (JP) ..... 2010-083185

(51) Int. Cl.
*H01R 3/00* (2006.01)
*H01R 12/68* (2011.01)
(Continued)

(52) U.S. Cl.
CPC ..... *H01R 12/68* (2013.01); *H01R 13/5202* (2013.01); *H01R 13/502* (2013.01); *H01R 13/516* (2013.01)
USPC ..... 439/499

(58) Field of Classification Search
CPC .. H01R 12/592; H01R 13/506; H01R 13/658; H01R 13/6658; H01R 4/023
USPC ..... 439/492, 499, 587, 465, 736, 936
See application file for complete search history.

(56) References Cited

U.S. PATENT DOCUMENTS 4,596,432 A * 6/1986 Tighe, Jr. ..... 439/466
6,434,316 B1 * 8/2002 Grois et al. ..... 385/139
(Continued)

FOREIGN PATENT DOCUMENTS

CA 2712152 A1 7/2010
EP 1204173 A2 5/2002
(Continued)

OTHER PUBLICATIONS

Japanese Notice of Rejection dated May 10, 2011.
(Continued)

*Primary Examiner* — Abdullah Riyami
*Assistant Examiner* — Vladimir Imas
(74) *Attorney, Agent, or Firm* — Sughrue Mion, PLLC

(57) ABSTRACT

A waterproof connector (1) comprises: retainers (50) and (60) which include an inner receiving portion (91) formed on opposite surfaces (51) and (61) which face a wiring substrate (30); and a first seal member (70) which is filled in at least the inner receiving portion (91). An outer receiving portion (92) is formed on outer surfaces (55) and (65) and side surfaces (50*d*), (50*e*), (60*d*), and (60*e*) of the retainers (50) and (60). Defective portions (58) and (68), which pass from the outer surfaces (55) and (65) to the inner receiving portion (91), are formed in the retainers (50) and (60). The inner receiving portion (91) communicates with the outer receiving portion (92) at the side surfaces (50*d*), (50*e*), (60*d*), and (60*e*). The first seal member (70) includes: an inner seal portion (70*a*) which is received in the inner receiving portion (91); and; a defective seal portion (70*d*) and a side seal portion (70*c*) which are formed integrally with the inner seal portion (70*a*). The defective seal portion (70*d*) and the side seal portion (70*c*) reach the outer surfaces (55) and (65).

13 Claims, 19 Drawing Sheets

(51) Int. Cl.

| | |
|---|---|
| ***H01R 13/52*** | (2006.01) |
| *H01R 13/502* | (2006.01) |
| *H01R 13/516* | (2006.01) |

(56) References Cited

U.S. PATENT DOCUMENTS

| | | | | |
|---|---|---|---|---|
| 6,454,594 | B2 * | 9/2002 | Sawayanagi | 439/467 |
| 6,520,788 | B2 * | 2/2003 | Ichida et al. | 439/271 |
| 6,638,090 | B2 * | 10/2003 | Wakata | 439/271 |
| 7,241,165 | B2 * | 7/2007 | Scheer et al. | 439/492 |
| 7,310,458 | B2 * | 12/2007 | Wehrly, Jr. | 385/14 |
| 7,354,308 | B2 * | 4/2008 | Iwahori | 439/587 |
| 7,419,395 | B2 * | 9/2008 | Tsuji et al. | 439/271 |
| 7,448,894 | B2 * | 11/2008 | Tsuji et al. | 439/271 |
| 7,758,378 | B2 * | 7/2010 | Yoshida et al. | 439/587 |
| 7,883,359 | B2 * | 2/2011 | Osaki et al. | 439/492 |
| 8,113,880 | B2 * | 2/2012 | Cappe et al. | 439/587 |
| 8,133,071 | B2 * | 3/2012 | Huang et al. | 439/499 |
| 2002/0052141 | A1 | 5/2002 | Hattori et al. | |
| 2002/0098735 | A1 | 7/2002 | Hattori et al. | |
| 2002/0098736 | A1 | 7/2002 | Hattori et al. | |
| 2007/0037436 | A1 * | 2/2007 | Iwahori | 439/422 |
| 2010/0279541 | A1 | 11/2010 | Osaki et al. | |

FOREIGN PATENT DOCUMENTS

| | | | |
|---|---|---|---|
| JP | 11-16628 | A | 1/1999 |
| JP | 2004-220864 | A | 8/2004 |
| JP | 2008-171596 | A | 7/2008 |
| WO | 2009/090998 | A1 | 7/2009 |

OTHER PUBLICATIONS

Japanese Decision of Rejection dated Aug. 2, 2011.
International Search Report for PCT/JP2011/058028 dated May 10, 2011.
Office Action issued by Korean Patent Office in Korean Application No. 10-2012-7028200 mailed Dec. 24, 2013.
European Search Report issued in European Application No. 11765649.6 mailed May 28, 2014.
Office Action issued by Chinese Patent Office in Chinese Application No. 20118001552.3 mailed Jul. 30, 2014.

* cited by examiner

WATERPROOF CONNECTOR

TECHNICAL FIELD

The present application claims priority from Japanese Patent Application No. 2010-083185 filed on Mar. 31, 2010 and International Application PCT/JP2011/58028 filed on Mar. 30, 2011. The contents described and/or illustrated in the documents relevant to the Japanese Patent Application No. 2010-083185 and International Application PCT/JP2011/58028 will be incorporated herein by reference as a part of the description and/or drawings of the present application.

The present invention relates to a waterproof connector that is used for the electrical connection of a wiring substrate.

BACKGROUND ART

A waterproof connector for a flexible substrate, where a flexible substrate on which terminals are mounted is held by a pair of retainers and a hot melt is filled between the flexible substrate and the retainer, is known (for example, see Patent Document 1).

CITATION LIST

Patent Document

Patent Document 1: WO 2009/090998 A

DISCLOSURE OF THE INVENTION

Problem to be Solved by the Invention

In the above-mentioned waterproof connector for a flexible substrate, there is a case that it is not possible to sufficiently improve the waterproof performance since the adhesion between the hot melt and the retainers deteriorates due to the shrinkage of the hot melt that is caused by the solidification of the hot melt filled between the flexible substrate and the retainers or fatigue that is caused by the change of the amount of the shrinkage of the hot melt during the use of the waterproof connector.

An object to be achieved by the invention is to provide a waterproof connector having excellent waterproof performance.

Means for Solving Problem

A waterproof connector according to the invention is a waterproof connector which is attached to a wiring substrate, the waterproof connector comprising: a pair of retainers between which the wiring substrate is interposed and which include an inner receiving portion formed on opposite surfaces which face the wiring substrate; and a first seal member which is made of a hot-melt seal material and is filled in at least the inner receiving portion, wherein an outer receiving portion in which the first seal member is received is formed on outer surfaces and side surfaces among surfaces of the pair of retainers which are along an inserting/separating direction of the waterproof connector, the outer surfaces which are opposite to the opposite surfaces, the side surfaces which cross the opposite surfaces and the outer surfaces, a defective portion, which passes from the outer surface to the inner receiving portion and in which the first seal member is to be filled, is formed in at least one of the retainers, the inner receiving portion communicates with the outer receiving portion at the side surfaces, the defective portion includes at least one of an opening or a cutout, the first seal member includes: an inner seal portion which is received in the inner receiving portion; and a connecting seal portion which is received in the defective portion and the outer receiving portion positioned on the side surfaces of the retainers and is formed integrally with the inner seal portion, and the connecting seal portion reaches the outer surfaces of the retainers.

In the invention, the defective portion may be formed over the entire overlap between the outer receiving portion and the inner receiving portion in an inserting/separating direction of the waterproof connector.

In the invention, the defective portion may be disposed so as to be axisymmetric about a center line of the inner receiving portion in the inserting/separating direction of the waterproof connector.

In the invention, the retainers may include a first retainer and a second retainer, the defective portion may include: a first defective portion which is formed in the first retainer; and a second defective portion which is formed in the second retainer, and the first and second defective portions may be disposed so as to face each other.

In the invention, a first protrusion, which protrudes toward the inside of the inner receiving portion, may be formed on the first retainer, a second protrusion, which protrudes toward the inside of the inner receiving portion, may be formed on the second retainer, and the first and second protrusions may be disposed so as to face each other.

A waterproof connector according to the invention is a waterproof connector which is attached to a wiring substrate, the waterproof connector comprising: a pair of retainers between which the wiring substrate is interposed and which include an inner receiving portion formed on opposite surfaces which face the wiring substrate; and a first seal member which is made of a hot-melt seal material and is filled in at least the inner receiving portion, wherein an outer receiving portion in which the first seal member is received is formed on outer surfaces and side surfaces among surfaces of the pair of retainers which are along an inserting/separating direction of the waterproof connector, the outer surfaces which are opposite to the opposite surfaces, the side surfaces which cross the opposite surfaces and the outer surfaces, a thin portion, which is formed by partially thinning the thickness between the outer surface and a bottom of the inner receiving portion, is formed in at least one of the retainers, the inner receiving portion communicates with the outer receiving portion at the side surfaces, the first seal member includes: an inner seal portion which is received in the inner receiving portion, and a connecting seal portion which is received in the outer receiving portion positioned on the side surfaces of the retainers and is formed integrally with the inner seal portion, the connecting seal portion reaches the outer surfaces of the retainers.

A waterproof connector according to the invention is a waterproof connector which is attached to a wiring substrateis, the waterproof connector comprising: a pair of retainers between which the wiring substrate is interposed and which include an inner receiving portion formed on opposite surfaces which face the wiring substrate, and a first seal member which is made of a hot-melt seal material and is filled in at least the inner receiving portion, wherein the retainers include: front end portions which are positioned on front end side of the retainers from the inner receiving portion in an inserting/separating direction of the waterproof connector; rear end portions which are positioned on rear end side of the retainers from the inner receiving portion in an inserting/separating direction of the waterproof connector; and connecting portions which partially connect the front end portions with the rear end portions and include the inner receiving portion, and the first seal member is received in the inner receiving portion and reaches outer surfaces of the connecting portions which are opposite to the opposite surfaces.

In the invention, the waterproof connector may further comprises: a connector body which includes the first seal member and the pair of retainers; a housing which receives the connector body; and a second seal member which is interposed between the connector body and the housing and seals between the connector body and the housing.

Effect of the Invention

According to the invention, a defective portion, which passes to an inner receiving portion from an outer surface, is formed in at least one of retainers, a first seal member includes: an inner seal portion that is received in the inner receiving portion; and a connecting seal portion that is received in the defective portion and an outer receiving portion positioned on the side surfaces of the retainers and is formed integrally with the inner seal portion, and the connecting seal portion reaches the outer surfaces of the retainers. Accordingly, it is possible to improve waterproof performance.

Further, according to the invention, a thin portion, which is formed by partially thinning the thickness between an outer surface and a bottom of an inner receiving portion, is formed in at least one of retainers, a first seal member includes: an inner seal portion that is received in the inner receiving portion; and a connecting seal portion that is received in an outer receiving portion positioned on side surfaces of the retainers and is formed integrally with the inner seal portion, and the connecting seal portion reaches the outer surfaces of the retainers. Accordingly, it is possible to improve waterproof performance.

Furthermore, according to the invention, retainers include connecting portions that partially connect front end portions with rear end portions, and a first seal member is received in an inner receiving portion and reaches outer surfaces of the connecting portions. Accordingly, it is possible to improve waterproof performance.

BEST MODE(S) FOR CARRYING OUT THE INVENTION

An embodiment of the invention will be described below with reference to the drawings.

Figure 1:
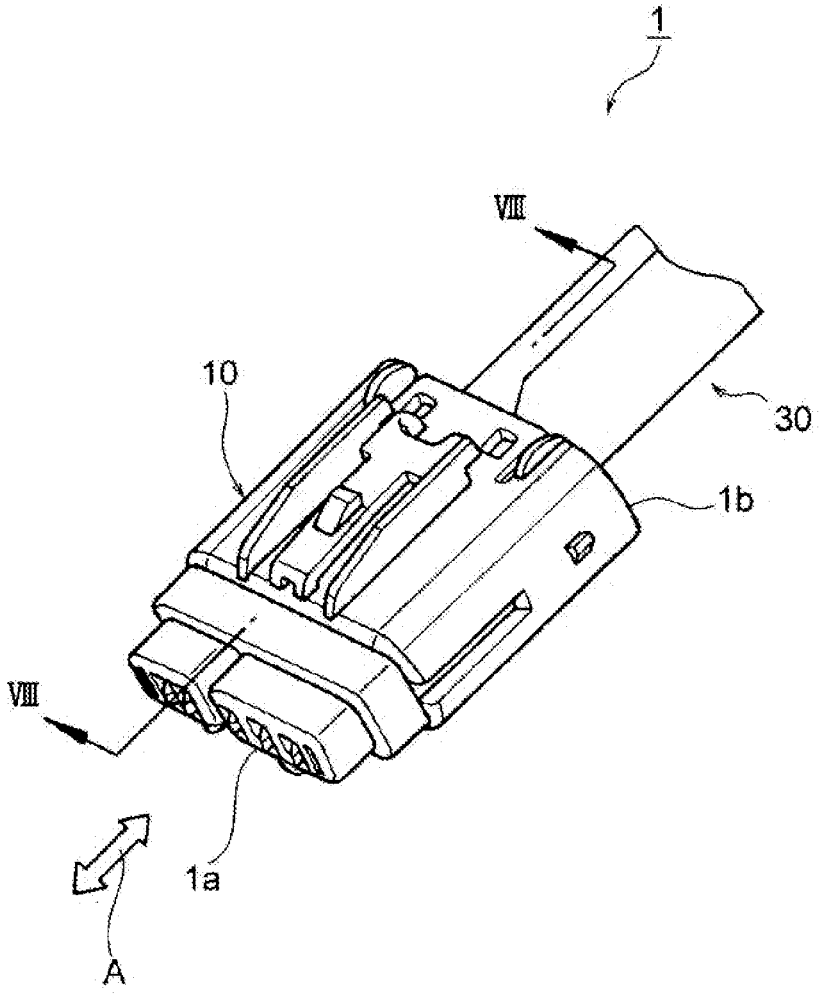
FIG. 1 is a perspective view of a waterproof connector in an embodiment of the invention.
Figure 2:
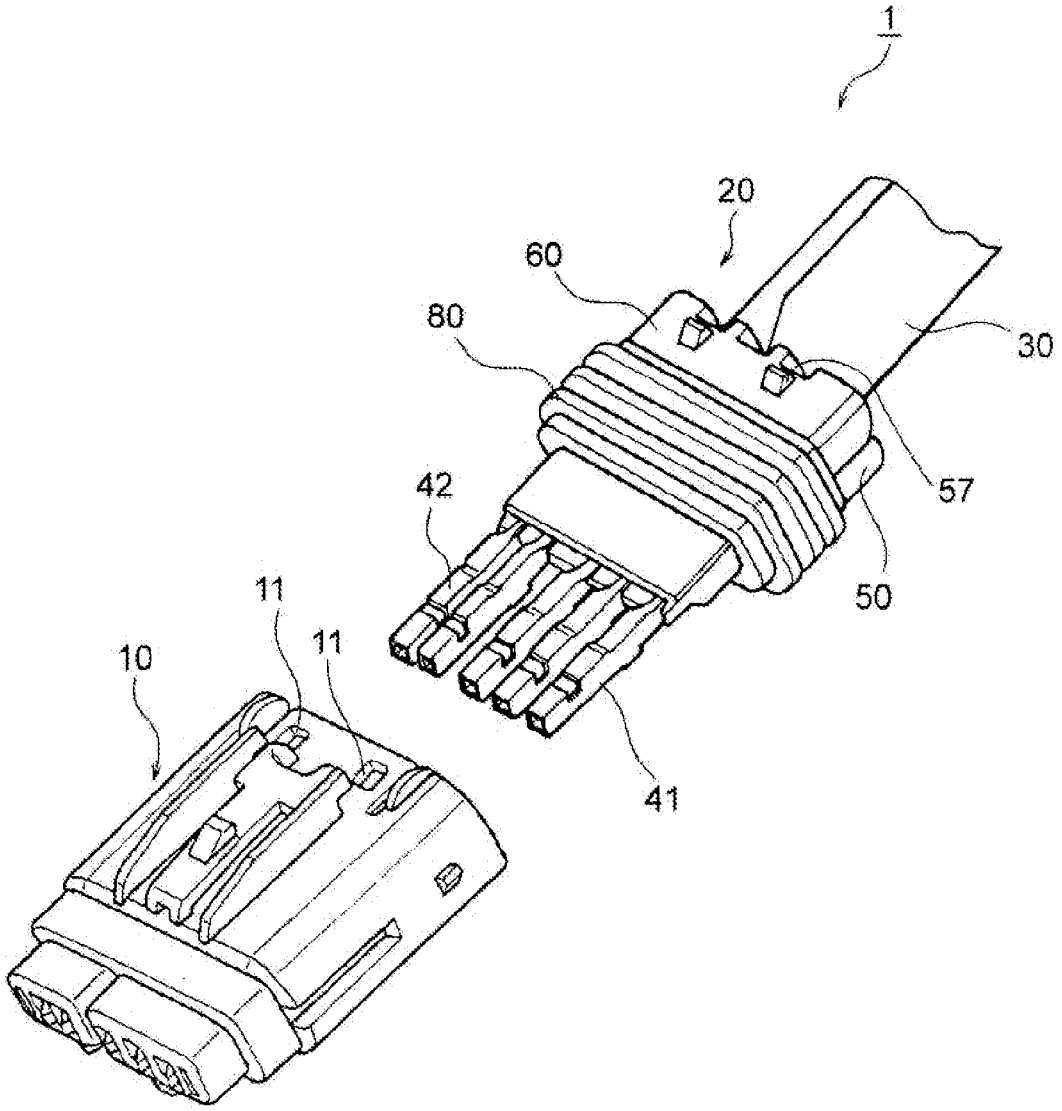
FIG. 2 is an exploded perspective view of the waterproof connector in the embodiment of the invention.
Figure 3:
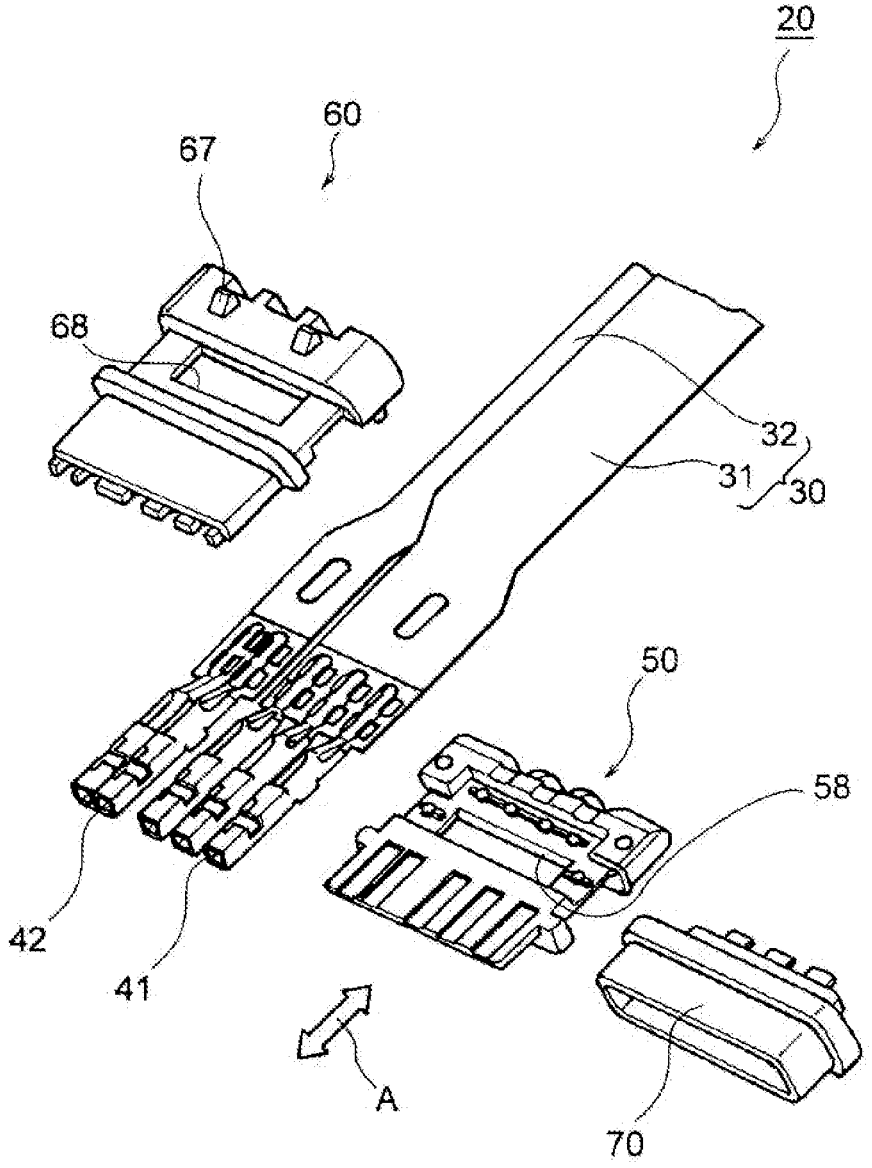
FIG. 3 is an exploded perspective view of a connector body in the embodiment of the invention.
Figure 4:
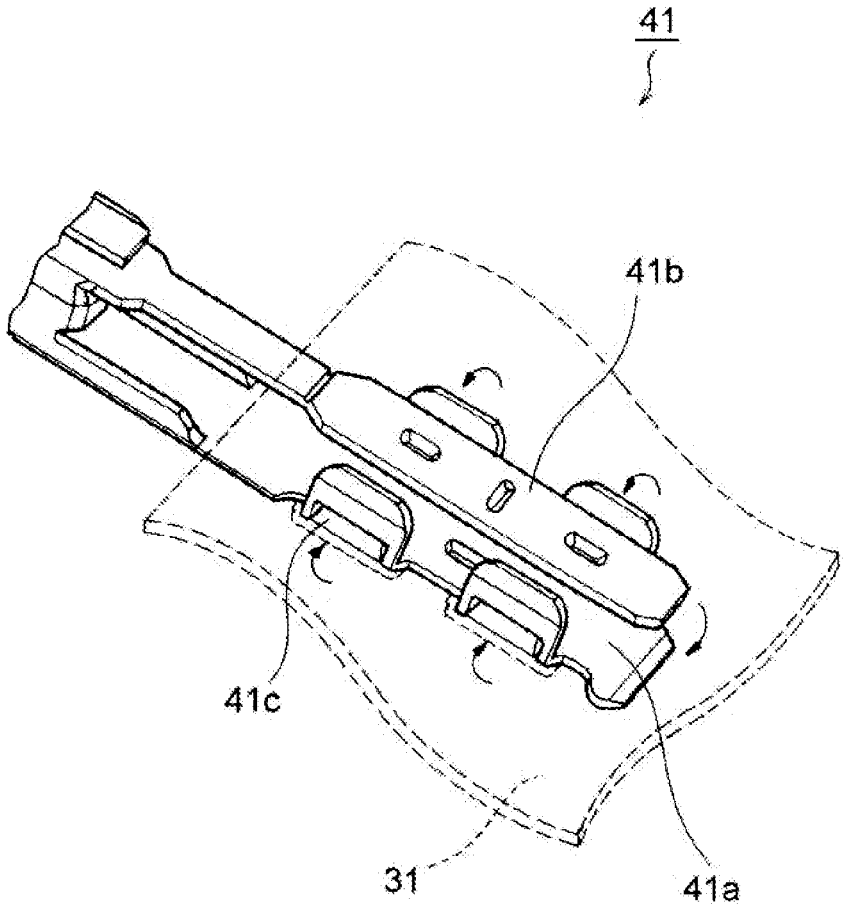
FIG. 4 is a perspective view of a first crimp terminal in the embodiment of the invention.
Figure 5:
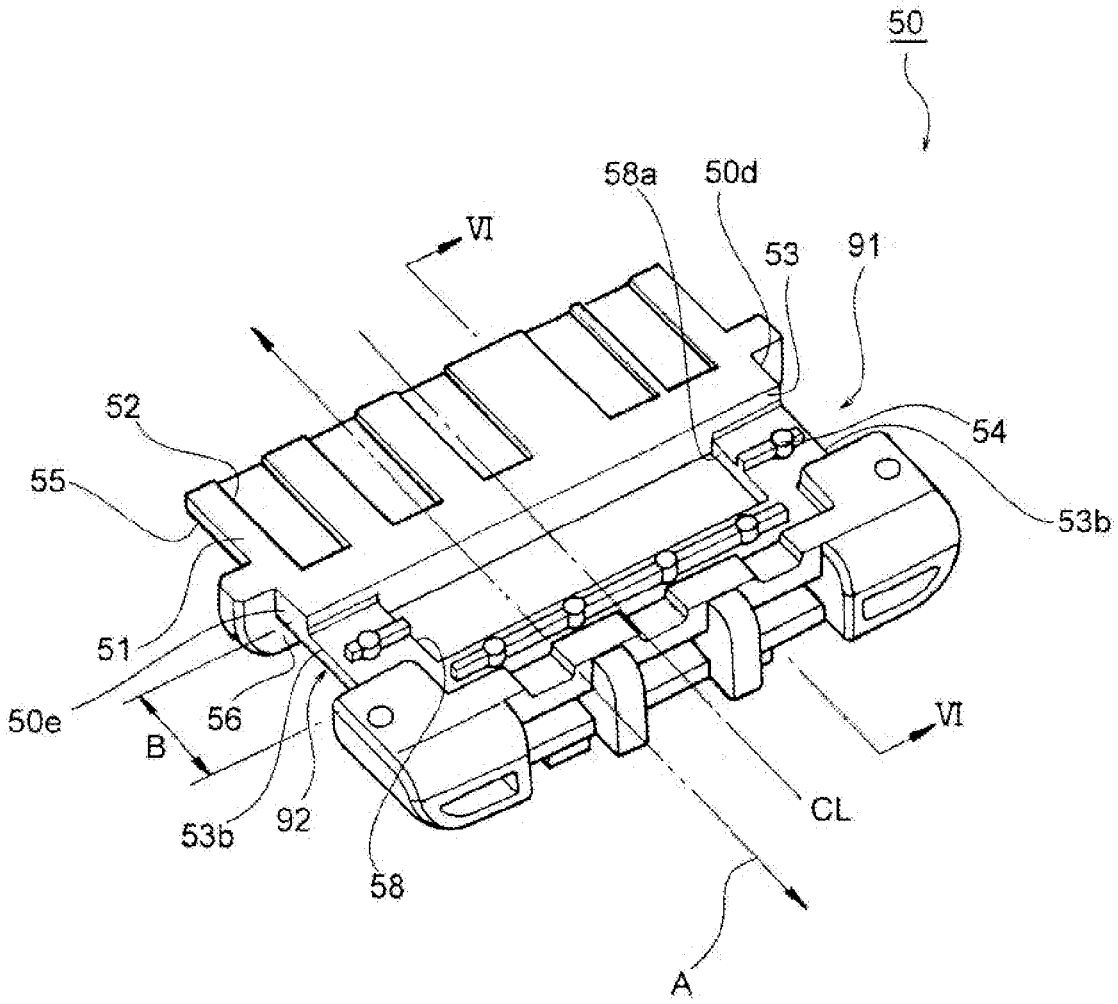
FIG. 5 is a perspective view of a first retainer in the embodiment of the invention.
Figure 6:
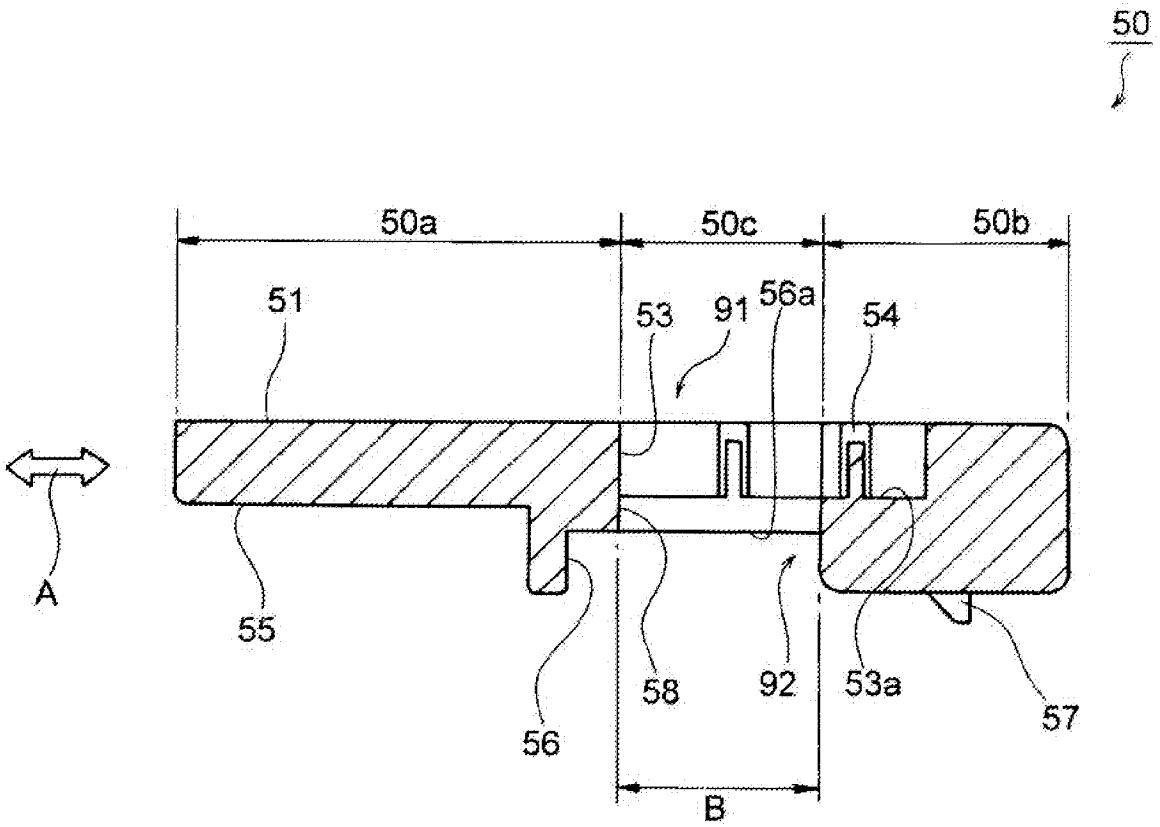
FIG. 6 is a cross-sectional view along line VI-VI of FIG. 5.
Figure 7:
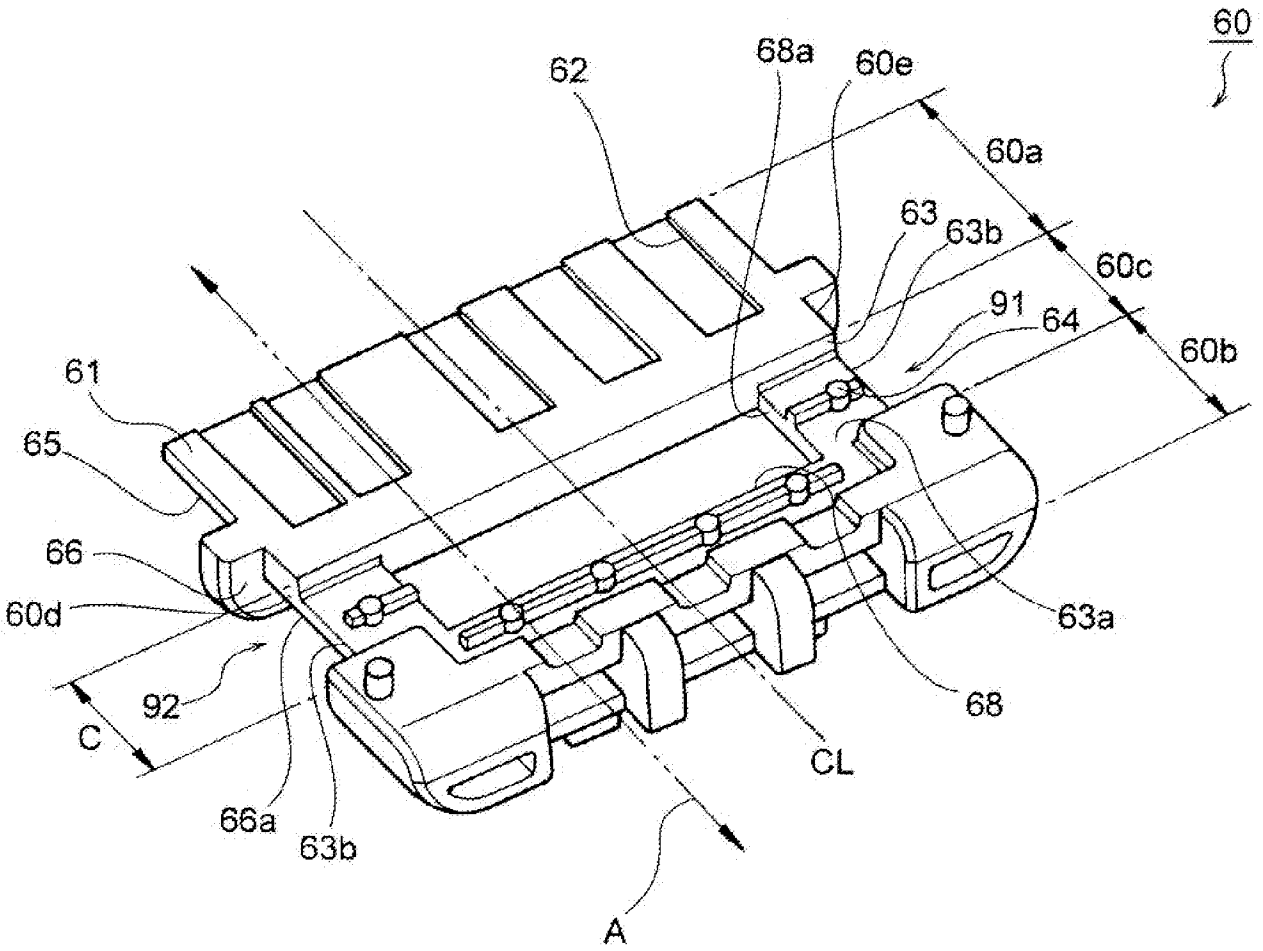
FIG. 7 is a perspective view of a second retainer of the embodiment of the invention.
Figure 8:
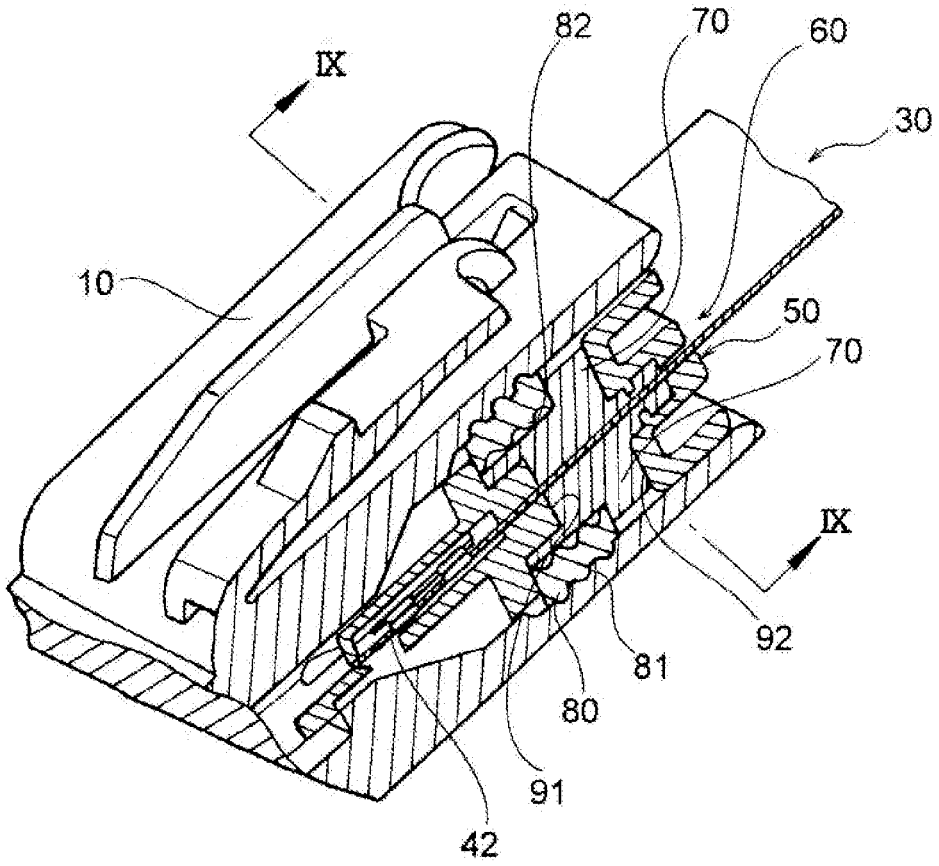
FIG. 8 is a cross-sectional perspective view along line VIII-VIII of FIG. 1.
Figure 9:
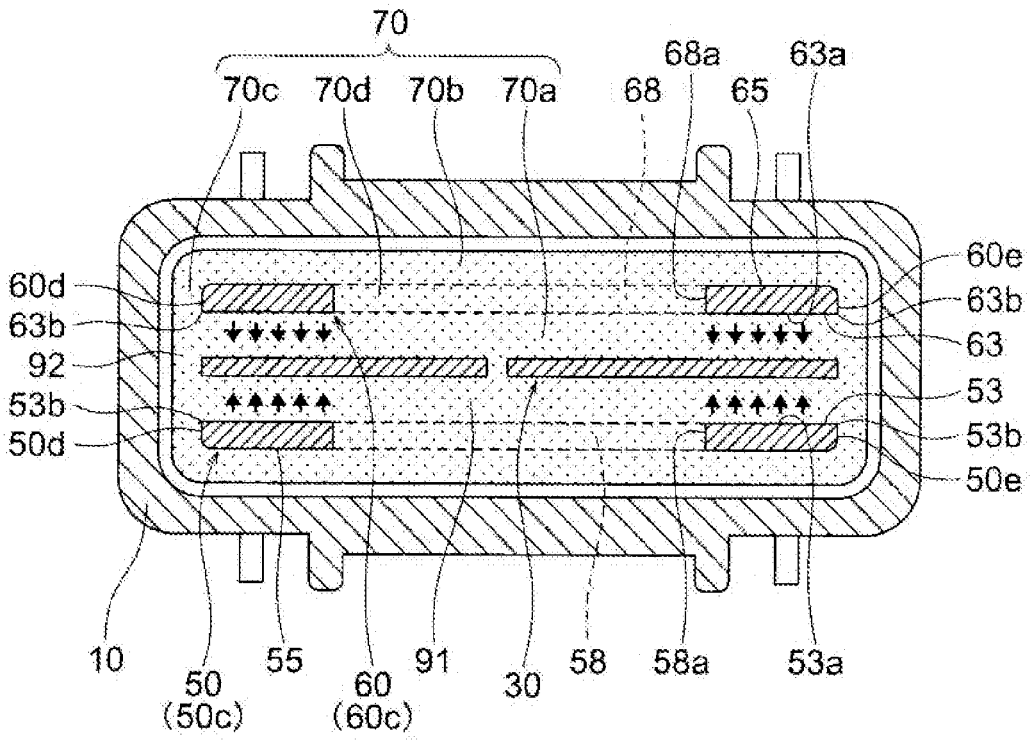
FIG. 9 is a cross-sectional view along line IX-IX of FIG. 8.
Figure 10:
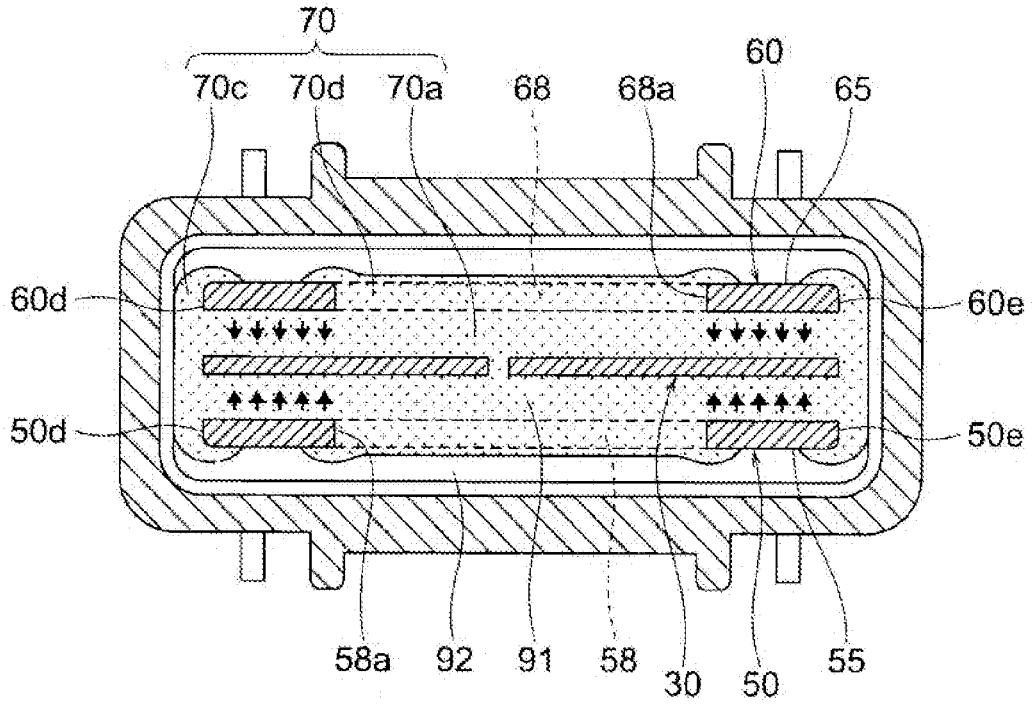
FIG. 10 is a cross-sectional view illustrating a first seal member of the waterproof connector in the embodiment of the invention.

FIG. 1 is a perspective view of a waterproof connector in this embodiment, FIG. 2 is an exploded perspective view of the waterproof connector in this embodiment, FIG. 3 is an exploded perspective view of a connector body in this embodiment, FIG. 4 is a perspective view of a first crimp terminal in this embodiment, FIG. 5 is a perspective view of a first retainer in this embodiment, FIG. 6 is a cross-sectional view along line VI-VI of FIG. 5, FIG. 7 is a perspective view of a second retainer in this embodiment, FIG. 8 is a cross-sectional perspective view along line VIII-VIII of FIG. 1, FIG. 9 is a cross-sectional view along line IX-IX of FIG. 8, and FIG. 10 is a cross-sectional view illustrating a first seal member of the waterproof connector in this embodiment.

A waterproof connector 1 (see FIG. 1) in this embodiment is a connector that is attached to a wiring substrate 30 (wiring material) electrically connecting an electronic component (for example, a seat occupancy sensor, a capacitive sensor, or the like) with an electronic control unit (ECU) or the like in an automobile. For example, the waterproof connector is attached to the other end of the wiring substrate of which one end is connected to an electronic component or the like, is assembled in a lower portion of a seat, and is connected to another connector. Note that, an arrow A illustrated in the drawings represents an inserting/separating direction in which the waterproof connector 1 is inserted into/separated from the another connector. Further, concerning the waterproof connector 1 in this embodiment, the side (left side in the drawings) thereof which is to be connected to another connector is referred to as a front end side 1*a* and the side (right side in the drawings) thereof opposite to this is referred to as a rear end side 1*b* in the inserting/separating direction A.

As illustrated in FIG. 2, the waterproof connector 1 includes a housing 10, a connector body 20, and a second seal member 80.

As illustrated in FIG. 2, the housing 10 is a member that receives the connector body 20. Engaging holes 11, which are engaged with first and second claw portions 57 and 67 (to be described below) formed on first and second retainers 50 and 60 of the connector body 20, are formed at upper and lower portions of the housing 10. Note that, the engaging holes 11, which are positioned at the lower portion of the housing 10, are not illustrated.

As illustrated in FIG. 3, the connector body 20 includes the first retainer 50, the second retainer 60, and a first seal member 70. Note that, the first and second retainers 50 and 60 of this embodiment correspond to an example of a pair of retainers of the invention. As illustrated in the figure, the wiring substrate 30 is attached to the connector body 20.

As illustrated in FIG. 3, the wiring substrate 30 includes a first wiring substrate 31 and a second wiring substrate 32. The first and second wiring substrates 31 and 32 are disposed adjacent to each other so that a gap is formed between end portions of the first and second wiring substrates.

The first wiring substrate 31 is a substrate where an electric circuit pattern (wiring) is formed on an insulating substrate. For example, a flexible printed circuit (FPC) board, a rigid printed wiring board, a membrane that is made of polyethylene naphthalate (PEN), polyethylene terephthalate (PET), or the like, and the like may be mentioned as the first wiring substrate 31. Further, the first wiring substrate 31 may comprise a substrate where wiring formed of rectangular conductors or round wires is laminated with an insulating substrate, or may comprise a flexible flat cable (FFC).

As illustrated in FIG. 3, three first crimp terminals 41 are mounted on the end portion of the first wiring substrate 31. The first crimp terminals 41 are receptacle type terminals, and pin type terminals (not illustrated) provided on the ECU or the like are fitted to the first crimp terminals. Note that, the first crimp terminals 41 may be pin type terminals and may be fitted to receptacle type terminals.

As illustrated in FIG. 4, the first crimp terminal 41 includes a lower plate 41*a*, an upper plate 41*b*, and barrels 41*c*.

The lower and upper plates 41*a* and 41*b* are members between which the first wiring substrate 31 is interposed. The barrels 41*c* are plate-like members that stand on the side portions of the lower plate 41*a*. In this embodiment, the barrels 41*c* are bent toward the upper plate 41*b* after being inserted into through holes (which are illustrated in FIG. 4 by a dotted line) formed in the first wiring substrate 31. Accordingly, the first wiring substrate 31 is fixed (crimped) between the lower and upper plates 41*a* and 41*b*.

Like the first wiring substrate 31, the second wiring substrate 32 is a substrate where an electric circuit pattern (wiring) is formed on an insulating substrate. For example, a flexible printed circuit board, a rigid printed wiring board, a membrane, and the like may be mentioned as the second wiring substrate 32. Further, the second wiring substrate 32 may comprise a substrate where wiring formed of rectangular conductors or round wires is laminated with an insulating substrate, or may comprise a flexible flat cable.

As illustrated in FIG. 3, two second crimp terminals 42 are mounted on the end portion of the second wiring substrate 32. Note that, the second crimp terminal 42 has the same structure as the structure of the first crimp terminal 41, and includes a lower plate, an upper plate, and barrels. The barrels are bent while the second wiring substrate 32 is interposed between the lower and upper plates. Accordingly, the second crimp terminal 42 is also crimped to the second wiring substrate 32.

The wiring substrate 30 of this embodiment includes two wiring substrates 31 and 32. However, the wiring substrate 30 is not particularly limited, and may be comprise one wiring substrate. For example, the wiring substrate 30 may comprise only the first wiring substrate 31 that includes five first crimp terminals 41 mounted on the end portion thereof. Moreover, the number of the first crimp terminals 41 and the number of the second crimp terminals 42 are also not particularly limited, and may be appropriately set according to the number of terminals of another connector that is to be connected to the waterproof connector 1.

The wiring substrate 30 is interposed between the first and second retainers 50 and 60 as illustrated in FIG. 3, and the first retainer 50 receives a force, which is applied when the waterproof connector 1 is inserted or separated, together with the second retainer 60.

As illustrated in FIGS. 5 and 6, first terminal receiving portions 52, a first inner groove 53, and first protrusions 54 are formed on a first opposite surface 51 of the first retainer 50 that faces the wiring substrate 30. Meanwhile, first claw portions 57 are formed on a first outer surface 55 which is opposite to the first opposite surface 51 among the surfaces of the first retainer 50 that are along the inserting/separating direction A of the waterproof connector 1. Further, a first outer groove 56 is continuously formed on the first outer surface 55 and first side surfaces 50*d* and 50*e* of the first retainer 50. Note that, as illustrated in FIG. 5, the first side surfaces 50*d* and 50*e* are surfaces which cross the first opposite surface 51 and the first outer surface 55 among the surfaces of the first retainer 50 that are along the inserting/separating direction A of the waterproof connector 1.

As illustrated in FIG. 5, the first terminal receiving portions 52 are recesses that are formed along the inserting/separating direction A of the waterproof connector 1. The first terminal receiving portions 52 receive the upper plates 41*a*, the lower plates 41*b*, and the barrels 41*c* of the respective first and second crimp terminals 41 and 42. In this embodiment, three first terminal receiving portions 52 are disposed at the left side portion of the first retainer 50 in FIG. 5 and receive three first crimp terminals 41. Meanwhile, two first terminal receiving portions 52 are disposed at the right side portion of the first retainer 50 in FIG. 5 and receive two second crimp terminals 42.

As illustrated in FIG. 5, the first inner groove 53 is formed on the first opposite surface 51 in a direction substantially orthogonal to the inserting/separating direction A. The first inner groove 53 is opened at the first side surfaces 50*d* and 50*e* so that the melted first seal member 70 flows into the first inner groove 53 through openings 53*b* of the first inner groove 53. Accordingly, the first inner groove 53 communicates with the first outer groove 56 through the openings 53*b*. Further, the first inner groove 53 forms an inner receiving portion 91, in which the melted first seal member 70 is to be filled, by being combined with a second inner groove 63 of the second retainer 60.

Here, as illustrated in FIG. 6, in the first retainer 50 of this embodiment, the front end side 1*a* (see FIG. 1) with respect to the first inner groove 53 is referred to as a first front end portion 50*a*, and the rear end side 1*b* (see FIG. 1) with respect to the first inner groove 53 is referred to as a first rear end portion 50*b*.

Further, the first front end portion 50*a* and the first rear end portion 50*b* of the first retainer 50 are partially connected to each other by first connecting portions 50*c* on which the first inner groove 53 (the inner receiving portion 91) is formed. That is, in this embodiment, a first defective portion 58 (to be described below) is formed between the first connecting portions 50*c*.

Here, when the waterproof connector 1 has been assembled, as illustrated in FIGS. 9 and 10, a side seal portion 70*c* and a defective seal portion 70*d* reach the first outer surface 55 of the first connecting portions 50*c* and the first connecting portions 50*c* are surrounded by an inner seal portion 70*a*, an outer seal portion 70*b*, the side seal portion 70*c*, and the defective seal portion 70*d*. Note that, the inner seal portion 70*a*, the outer seal portion 70*b*, the side seal portion 70*c*, and the defective seal portion 70*d* will be described below.

As illustrated in FIGS. 5 and 6, the first protrusions 54 protrude from a bottom 53*a* of the first inner groove 53 toward the inner receiving portion 91 and the upper ends of the first protrusions 54 come into contact with the wiring substrate 30. In this embodiment, a plurality of first protrusions 54 are formed in the first inner groove 53 and ribs are formed between the first protrusions 54 except for a portion of the first inner groove 53 in which the first defective portion 58 is formed.

As illustrated in FIGS. 5 and 6, the first outer groove 56 is formed on the first outer surface 55 and first side surfaces 50*d* and 50*e* of the first retainer 50 in a direction substantially orthogonal to the inserting/separating direction A. Further, the first outer groove 56 communicates with the first inner groove 53 through the openings 53*b*.

The first outer groove 56 is combined with a second outer groove 66 of the second retainer 60, so that an outer receiving portion 92 receiving the first seal member 70 is formed on the outer surfaces 55 and 65 and the side surfaces 50*d*, 50*e*, 60*d*, and 60*e* of the first and second retainers 50 and 60.

As illustrated in FIG. 6, the first claw portions 57 are protruding portions that are formed on the first outer surface 55 of the first rear end portion 50*b*. The first claw portions 57 are fitted to the engaging holes 11 of the above-mentioned housing 10. Accordingly, the connector body 20 is fixed to the housing 10.

Moreover, since the first defective portion 58, which passes to the inner receiving portion 91 from the first outer surface 55, is formed in the first retainer 50 of this embodiment as illustrated in FIGS. 5 and 6, the first seal member 70 is filled in the first defective portion 58.

The first defective portion 58 will be described in detail. The first defective portion 58 passes between the bottom 53*a* of the first inner groove 53 and a bottom 56*a* of the first outer groove 56. Further, in plane view, the first defective portion 58 is formed over the entire overlap B between the outer receiving portion 92 and the inner receiving portion 91 in the inserting/separating direction A of the waterproof connector 1. As illustrated in FIG. 5, the first defective portion 58 of this embodiment is an opening that is axisymmetric about a center line CL of the inner receiving portion 91 (the first inner groove 53) which is along the inserting/separating direction A of the waterproof connector 1.

The first retainer 50, which has been described above, is made of a material that has thermal resistance higher than the melting temperature of the first seal member 70 to be described below and has a coefficient of linear expansion lower than that of the first seal member 70. For example, if the first seal member 70 is made of polyamide, for example, polybutylene terephtalate (PBT) may be mentioned as a material of the first retainer 50.

As illustrated in FIG. 3, the second retainer 60 is a member that makes the wiring substrate 30 be interposed between the first retainer 50 and itself. Note that, the second retainer 60 is separated from the first retainer 50 in this embodiment, but is not particularly limited. For example, the second retainer 60 may be connected to the first retainer 50 by a hinge or the like.

As illustrated in FIG. 7, second terminal receiving portions 62, a second inner groove 63, and second protrusions 64 are formed on a second opposite surface 61 of the second retainer 60 that faces the wiring substrate 30. Meanwhile, second claw portions 67 (see FIG. 3) are formed on a second outer surface 65, which is opposite to the second opposite surface 61, among the surfaces of the second retainer 60 that are along the inserting/separating direction A of the waterproof connector 1. Further, the second outer groove 66 is continuously formed on the second outer surface 65 and second side surfaces 60*d* and 60*e* of the second retainer 60. Note that, as illustrated in FIG. 7, the second side surfaces 60*d* and 60*e* are surfaces, which cross the second opposite surface 61 and the second outer surface 65, among the surfaces of the second retainer 60 that are along the inserting/separating direction A of the waterproof connector 1.

As illustrated in FIG. 7, the second terminal receiving portions 62 are recesses that are formed in the inserting/separating direction A so as to face the first terminal receiving portions 52 of the first retainer 50. The second terminal receiving portions 62 receive the first and second crimp terminals 41 and 42 together with the first terminal receiving portions 52.

As illustrated in the figure, the second inner groove 63 is formed on the second opposite surface 61 along a direction substantially orthogonal to the inserting/separating direction A so as to face the first inner groove 53 of the first retainer 50. The second inner groove 63 forms the inner receiving portion 91, in which the melted first seal member 70 is to be filled, by being combined with the first inner groove 53 of the first retainer 50.

Like the first inner groove 53, the second inner groove 63 is also opened at the second side surfaces 60*d* and 60*e* so that the melted first seal member 70 flows into the second inner groove 63 through openings 63*b* of the second inner groove 63. Accordingly, the second inner groove 63 communicates with the second outer groove 66 through the openings 63*b*. For this reason, the inner receiving portion 91 of this embodiment communicates with the outer receiving portion 92 at the side surfaces 50*d*, 50*e*, 60*d*, and 60*e* of the first and second retainers 50 and 60.

Here, as illustrated in FIG. 7, in the second retainer 60 of this embodiment, the front end side 1*a* (see FIG. 1) with respect to the second inner groove 63 is referred to as a second front end portion 60*a*, and the rear end side 1*b* (see FIG. 1) with respect to the second inner groove 63 (to be described below) is referred to as a second rear end portion 60*b*.

Further, the second front end portion 60*a* and the second rear end portion 60*b* of the second retainer 60 are partially connected to each other by second connecting portions 60*c* on which the second inner groove 63 (the inner receiving portion 91) is formed. That is, in this embodiment, a second defective portion 68 (to be described below) is formed between the second connecting portions 60*c*.

Here, when the waterproof connector 1 has been assembled, as illustrated in FIGS. 9 and 10, the side seal portion 70*c* and the defective seal portion 70*d* reach the second outer surface 65 of the second connecting portions 60*c* and the second connecting portions 60*c* are surrounded by the inner seal portion 70*a*, the outer seal portion 70*b*, the side seal portion 70*c*, and the defective seal portion 70*d*. Note that, the inner seal portion 70*a*, the outer seal portion 70*b*, the side seal portion 70*c*, and the defective seal portion 70*d* will be described below.

As illustrated in FIG. 7, the second protrusions 64 protrude from a bottom 63*a* of the second inner groove 63 toward the inner receiving portion 91 and the upper ends of the second protrusions 64 come into contact with the wiring substrate 30. Further, when the wiring substrate 30 is interposed between the first and second retainers 50 and 60, the second protrusions 64 are disposed so as to face the first protrusions 54, so that the wiring substrate 30 is interposed between the first and second protrusions 54 and 64. In this embodiment, a plurality of second protrusions 64 are formed in the second inner groove 63 and ribs are formed between the second protrusions 64 except for a portion of the second inner groove 63 in which the second defective portion 68 (to be described below) is formed.

As illustrated in the figure, the second outer groove 66 is formed on the second side surfaces 60*d* and 60*e* and the second outer surface 65 of the second retainer 60 in a direction substantially orthogonal to the inserting/separating direction A. Moreover, the second outer groove 66 communicates with the second inner groove 63 through the openings 63*b*.

As described above, the second outer groove 66 is combined with the first outer groove 56 of the first retainer 50 so that the outer receiving portion 92 receiving the first seal member 70 is formed on the outer surfaces 55 and 65 and the side surfaces 50*d*, 50*e*, 60*d*, and 60*e* of the first and second retainers 50 and 60.

Like the first claw portions 57, the second claw portions 67 are protruding portions that are to be fitted to the engaging holes 11 of the above-mentioned housing 10. The second claw portions 67 are formed on the second outer surface 65 of the second rear end 60*b* (see FIG. 3).

Moreover, since the second defective portion 68, which passes from the second outer surface 65 to the inner receiving portion 91, is formed in the second retainer 60 of this embodiment as illustrated in FIG. 7, the melted first seal member 70 is also filled in the second defective portion 68.

The second defective portion 68 will be described in detail. The second defective portion 68 passes between the bottom 63*a* of the second inner groove 63 and a bottom 66*a* of the second outer groove 66. Further, in plane view, the second defective portion 68 is formed over the entire overlap C between the inner receiving portion 91 and the outer receiving portion 92 in the inserting/separating direction A of the waterproof connector 1.

The second defective portion 68 of this embodiment is an opening that is axisymmetric about a center line CL of the inner receiving portion 91 (the second inner groove 63) which is along the inserting/separating direction A of the waterproof connector 1. Furthermore, when the wiring substrate 30 is interposed between the first and second retainers 50 and 60, the second defective portion 68 is disposed so as to face the first defective portion 58.

Further, the size of the second defective portion 68 of this embodiment is substantially the same as that of the first defective portion 58, but is not particularly limited. For example, the second defective portion 68 may be formed to be relatively smaller than the first defective portion 58.

Like the first retainer 50, the second retainer 60, which has been described above, is made of a material that has thermal resistance higher than the melting temperature of the first seal member 70 and has a coefficient of linear expansion lower than that of the first seal member 70. For example, if the first seal member 70 is made of polyamide, for example, polybutylene terephtalate may be mentioned as a material of the second retainer 60.

As illustrated in FIGS. 8 and 9, the first seal member 70 is filled in the inner receiving portion 91 and seals between the first retainer 50 and the wiring substrate 30 and between the second retainer 60 and the wiring substrate 30. Further, in this embodiment, the first seal member 70 is also received in the outer receiving portion 92. The first seal member 70 is made of a hot-melt seal material (hot-melt adhesive). Note that, for example, a thermoplastic resin material such as polyamide may be used as the material of the first seal member 70.

As illustrated in FIG. 9, the first seal member 70 includes the inner seal portion 70*a*, the outer seal portion 70*b*, the side seal portion 70*c*, and the defective seal portion 70*d*. Note that, the side seal portion 70*c* and the defective seal portion 70*d* of this embodiment correspond to an example of a connecting seal portion of the invention.

As illustrated in the figure, the inner seal portion 70*a* is received in the inner receiving portion 91 and seals between the wiring substrate 30 and the first and second retainers 50 and 60. The outer seal portion 70*b* is received in the outer receiving portion 92 that is positioned on the outer surfaces 55 and 65 of the first and second retainers 50 and 60, and fixes the first and second retainers 50 and 60, which come into close contact with each other, through the side seal portion 70*c*.

As illustrated in the figure, the side seal portion 70*c* is received in the outer receiving portion 92 that is positioned on the side surfaces 50*d*, 50*e*, 60*d*, and 60*e* of the first and second retainers 50 and 60; and is formed integrally with the inner seal portion 70*a* through the openings 53*b* and 63*b* of the inner grooves 53 and 63 of the first and second retainers 50 and 60. The side seal portion 70*c* reaches the outer surfaces 55 and 65 of the first and second retainers 50 and 60, and is connected to the outer seal portion 70*b*.

As illustrated in the figure, the defective seal portion 70*d* is received in the first and second defective portions 58 and 68 of the first and second retainers 50 and 60 and is formed integrally with the inner seal portion 70*a*. Further, the defective seal portion 70*d* reaches the outer surfaces 55 and 65 of the first and second retainers 50 and 60 and is connected to the outer seal portion 70*b*.

As illustrated in FIGS. 2 and 8, the second seal member 80 surrounds the connector body 20 (the first and second retainers 50 and 60) and seals between the housing 10 and the connector body 20. For example, an O-ring or a rubber packing, a sealing resin, and the like may be mentioned as the second seal member 80.

As illustrated in FIG. 8, grooves 81 are formed on the outer peripheral surface of the second seal member 80 coming into contact with the housing 10 so that the adhesion between the housing 10 and the second seal member 80 is improved. Moreover, as illustrated in the figure, convex portions 82, which string in a ring shape, are formed on the inner peripheral surface of the second seal member 80 coming into contact with the connector body 20 (the first seal member 70). Accordingly, the positional deviation between the connector body 20 and the second seal member 80 is suppressed and the adhesion between the connector body 20 and the second seal member 80 is improved.

Next, the operation of the waterproof connector 1 in this embodiment will be described.

In the waterproof connector 1 of this embodiment, the wiring substrate 30 is interposed between the first and second retainers 50 and 60 for the mechanical reinforcement. Note that, in this embodiment, the first and second retainers 50 and 60 are combined with each other and function as a single reinforcing member.

Further, the first seal member 70 made of a hot-melt seal material seals between the wiring substrate 30 and the first and second retainers 50 and 60, and waterproofs the waterproof connector 1 (particularly, the crimp terminals 41 and 42).

In order to seal the inner portion of the waterproof connector 1 by the first seal member 70 in this way, the first and second retainers 50 and 60, between which the wiring substrate 30 has been interposed, are set in a die (not illustrated) and the first seal member 70 (hot-melt seal material), which is melted by heating, is filled in at least the inner receiving portion 91 and is solidified by cooling. Note that, when the first seal member 70 is made of polyamide, about 185° C. may be mentioned as heating temperature for the melting of the first seal member 70.

Here, the adhesion between the first seal member and the retainers may deteriorate due to thermal stress that is generated between the first seal member and the retainers (particularly, the opposite surfaces) in connection with the solidification of the first seal member 70 filled between the wiring substrate 30 and the first and second retainers 50 and 60 or fatigue that occurs due to the change of thermal stress caused by temperature change during the use of the waterproof connector. For this reason, there is a case that the waterproof performance of the waterproof connector may not be sufficiently improved.

Further, when the number of the terminals of the waterproof connector is increased or a wide wiring substrate is assembled in the waterproof connector, large retainers need to be used for the waterproof connector. In this case, since the retainers are not deformed so as to follow the shrinkage of the first seal member, the adhesion between the first seal member and the retainers tends to more deteriorate.

In this regard, in the waterproof connector 1 of this embodiment, the side seal portion 70*c* received in the outer receiving portion 92 reaches the outer surfaces 55 and 65 of the first and second retainers 50 and 60 as illustrated in FIG. 9.

Further, in the waterproof connector 1 of this embodiment, as illustrated in the figure, the first and second defective portions 58 and 68 are formed in the first and second retainers 50 and 60 and the defective seal portion 70*d* received in the first and second defective portions 58 and 68 also reaches the outer surfaces 55 and 65.

Furthermore, the side seal portion 70*c* and the inner seal portion 70*a* are formed integrally, and the defective seal portion 70*d* and the inner seal portion 70*a* are formed integrally.

For this reason, when the inner seal portion 70*a*, the side seal portion 70*c*, and the defective seal portion 70*d* shrink in this embodiment, the side seal portion 70*c* and the defective seal portion 70*d* which reach the outer surfaces 55 and 65 pull the first and second retainers 50 and 60 toward the inner seal portion 70*a*.

Meanwhile, since the first and second defective portions 58 and 68 are formed in the first and second retainers 50 and 60, the rigidity of the first and second retainers 50 and 60 is low. Accordingly, the first and second retainers 50 and 60 are easily deformed following the shrinkage of the inner seal portion 70*a* or the side seal portion 70*c* and the defective seal portion 70*d*.

For this reason, in the waterproof connector 1 of this embodiment, thermal stress (which is illustrated by arrows of FIG. 9) generated between the first seal member 70 and the first and second retainers 50 and 60 is reduced, so that the strong adhesion between the first seal member 70 (the inner seal portion 70*a*) and the first and second retainers 50 and 60 (the bottoms 53*a* and 63*a* of the first and second inner grooves 53 and 63) is maintained. Accordingly, it is possible to improve waterproof performance. Further, when the retainers are increased in size due to the increase of the number of the terminals of the waterproof connector, the above-mentioned effects are particularly significant.

Furthermore, as described above, the waterproof performance of the waterproof connector 1 in this embodiment is to be improved, and particularly, the durability of the waterproof connector 1 is improved under thermal cycle (which repeats to apply temperature of −40° C. to 85° C.). Accordingly, the life of the waterproof connector 1 itself is lengthened.

If the first seal member 70 includes the inner seal portion 70*a*, the side seal portion 70*c*, and defective seal portion 70*d* as illustrated in FIG. 10 as described above, the above-mentioned effects are obtained. Accordingly, the first seal member 70 does not need to include the outer seal portion 70*b*. However, if the first seal member 70 includes the outer seal portion 70*b*, the following effects are further obtained.

That is, since the outer seal portion 70*b* is connected to the inner seal portion 70*a* through the side seal portion 70*c* and the defective seal portion 70*d*, the outer seal portion 70*b* presses the outer surfaces 55 and 65 of the first and second retainers 50 and 60 in addition to the side seal portion 70*c* and the defective seal portion 70*d* when the first seal member 70 shrinks.

For this reason, the first and second retainers 50 and 60 are more easily deformed so as to follow the shrinkage of the inner seal portion 70*a*, so that the thermal stress generated between the first seal member 70 and the first and second retainers 50 and 60 is further reduced. Accordingly, the strong adhesion between the first seal member 70 and the first and second retainers 50 and 60 is maintained in the waterproof connector 1 of this embodiment, so that it is possible to effectively improve waterproof performance.

Further, as illustrated in FIGS. 5 and 6, the first defective portion 58 passes through the overlap B of the first retainer 50 between the inner and outer receiving portions 91 and 92 in plane view. Furthermore, the first defective portion 58 is formed over the entire overlap B in the inserting/separating direction A of the waterproof connector 1. Likewise, as illustrated in FIG. 7, the second defective portion 68 also passes through the overlap C of the second retainer 60 between the inner and outer receiving portions 91 and 92 in plane view. Moreover, the second defective portion 68 is formed over the entire overlap C in the inserting/separating direction A of the waterproof connector 1.

By forming the first and second defective portions 58 and 68 over a wide range along the inserting/separating direction A of the waterproof connector 1, it is possible to ensure the strong adhesion between the first seal member 70 and the first and second retainers 50 and 60 over a wide range.

Further, in this embodiment, the first and second defective portions 58 and 68 face each other as illustrated in FIG. 9. For this reason, in the waterproof connector 1 of this embodiment, the wiring substrate 30 is interposed between the first and second retainers 50 and 60 together with the first seal member 70 even in the inner receiving portion 91. Accordingly, since the thermal stress generated between the first retainer 50 and the first seal member 70 and the thermal stress generated between the second retainer 60 and the first seal member 70 are generated so as to be axisymmetric about the wiring substrate 30, it is possible to suppress the distortion or bending of the wiring substrate 30.

In addition to this, since the first and second defective portions 58 and 68 have substantially the same size, the thermal stress generated between the first retainer 50 and the first seal member 70 is substantially the same as the thermal stress generated between the second retainer 60 and the first seal member 70. Accordingly, it is possible to further suppress the distortion or bending of the wiring substrate 30.

In this embodiment, the wiring substrate 30 is interposed between the first and second protrusions 54 and 64 in the inner receiving portion 91. Accordingly, when the inner receiving portion 91 is filled with the melted first seal member 70, the attitude of the wiring substrate 30 is stable.

Further, when a sudden temperature change (thermal cycle) is applied to the waterproof connector 1, there is a concern that the contact surfaces of the first seal member 70 and the wiring substrate 30 deviate from each other and the adhesion between the first seal member 70 and the wiring substrate 30 deteriorates. Even in this regard, it is possible to suppress the deviation of the contact surfaces of the first seal member 70 and the wiring substrate 30 by making the wiring substrate 30 be interposed between the first and second protrusions 54 and 64 as in this embodiment. As a result, the adhesion between the first seal member 70 and the wiring substrate 30 is maintained.

Furthermore, in this embodiment, the first and second defective portions 58 and 68 are axisymmetric about the center line CL of the inner receiving portion 91 in the inserting/separating direction A of the waterproof connector 1. For this reason, the waterproof connector 1 in this embodiment can receive a force, which is applied when the waterproof connector is inserted or separated, with a good balance and can suppress the deformation of the first and second retainers 50 and 60 when the waterproof connector 1 is inserted or separated.

Figure 15:
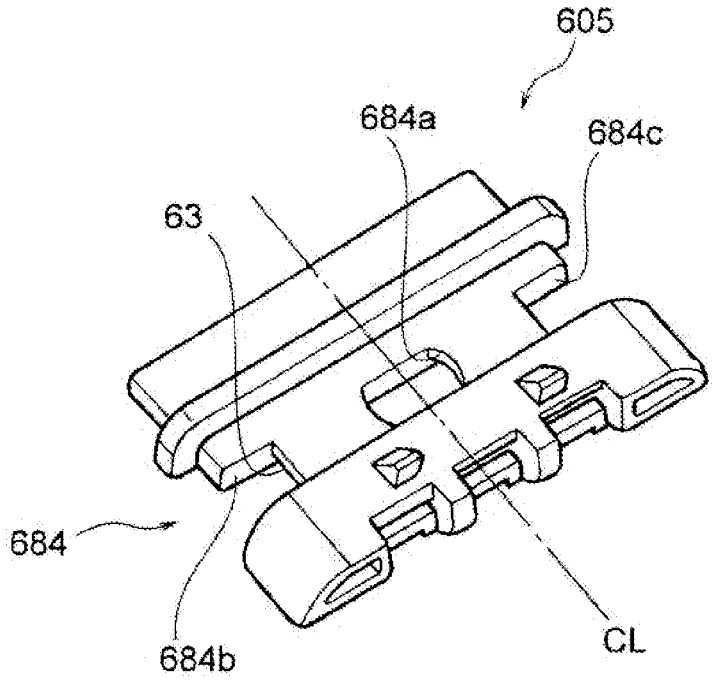
FIG. 15 is a perspective view illustrating a fifth modification of the first and second retainers in the embodiment of the invention.
Figure 15:
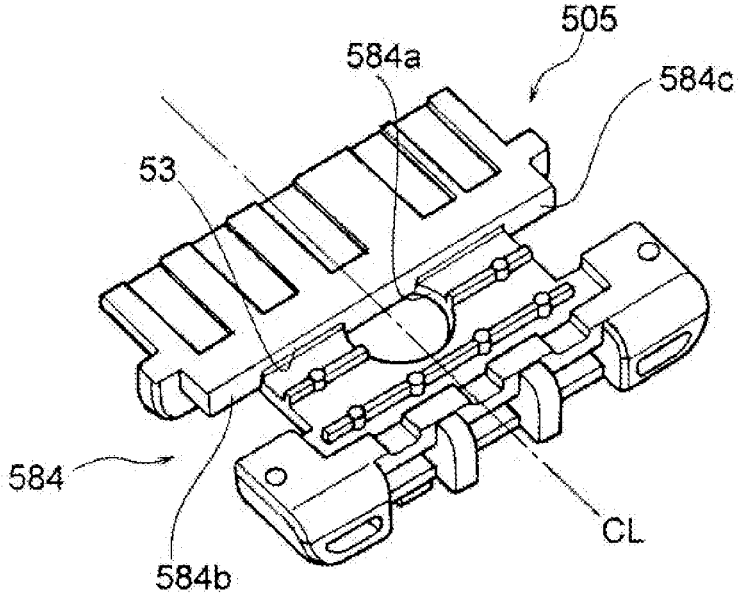
Figure 16:
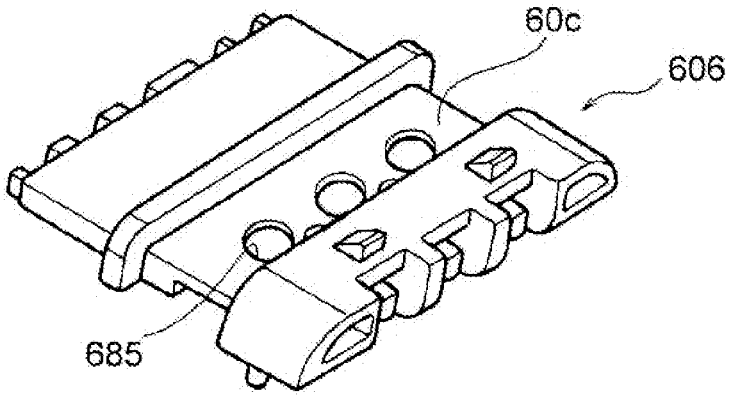
FIG. 16 is a perspective view illustrating a sixth modification of the first and second retainers in the embodiment of the invention.
Figure 16:
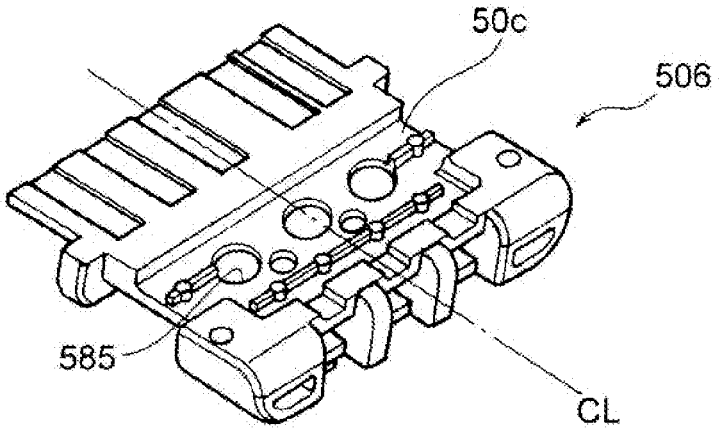
Figure 17:
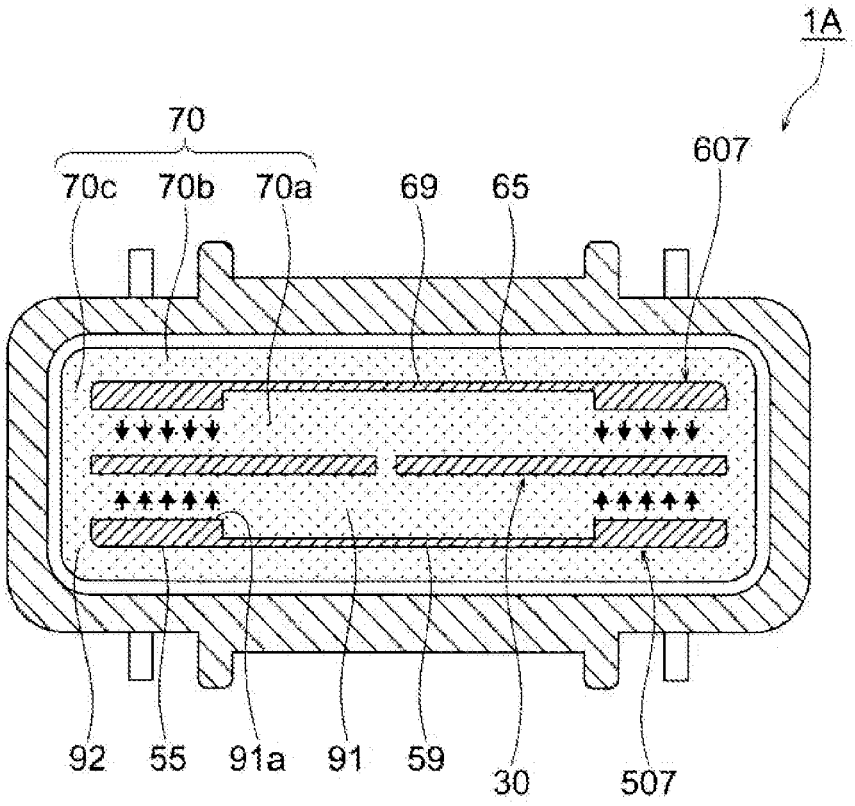
FIG. 17 is a cross-sectional view illustrating a modification of the waterproof connector in the embodiment of the invention.
Figure 18:
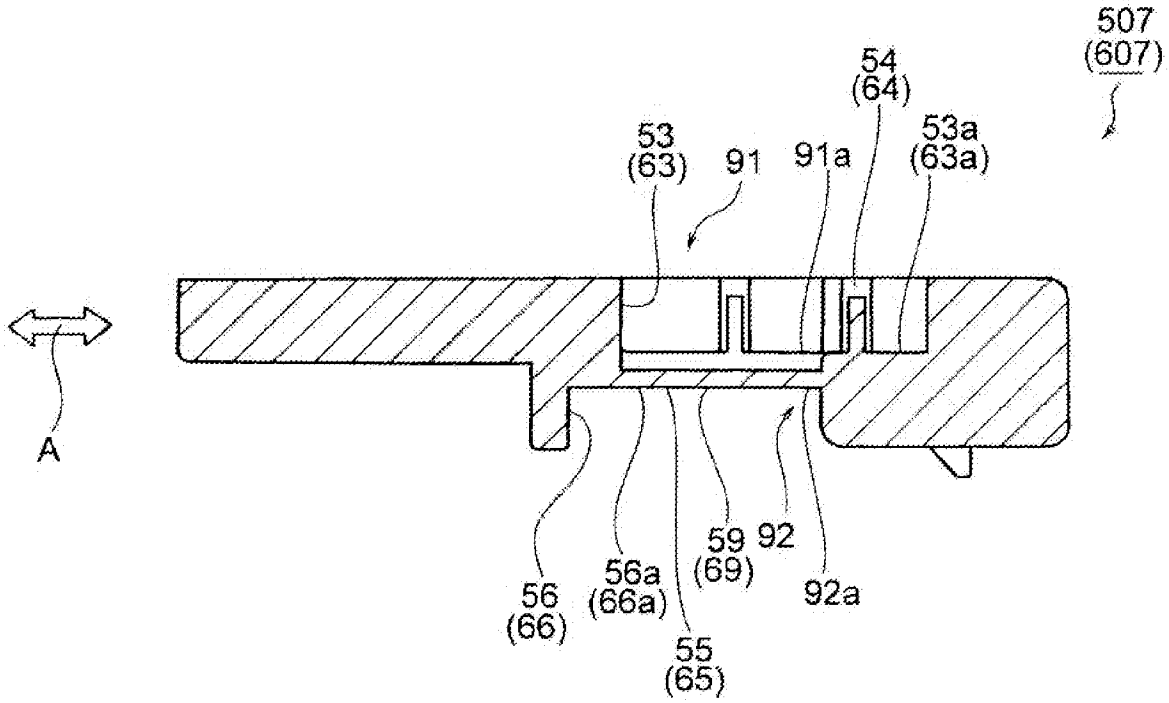
FIG. 18 is a cross-sectional view of a retainer of the waterproof connector illustrated in FIG. 17.
Figure 19:
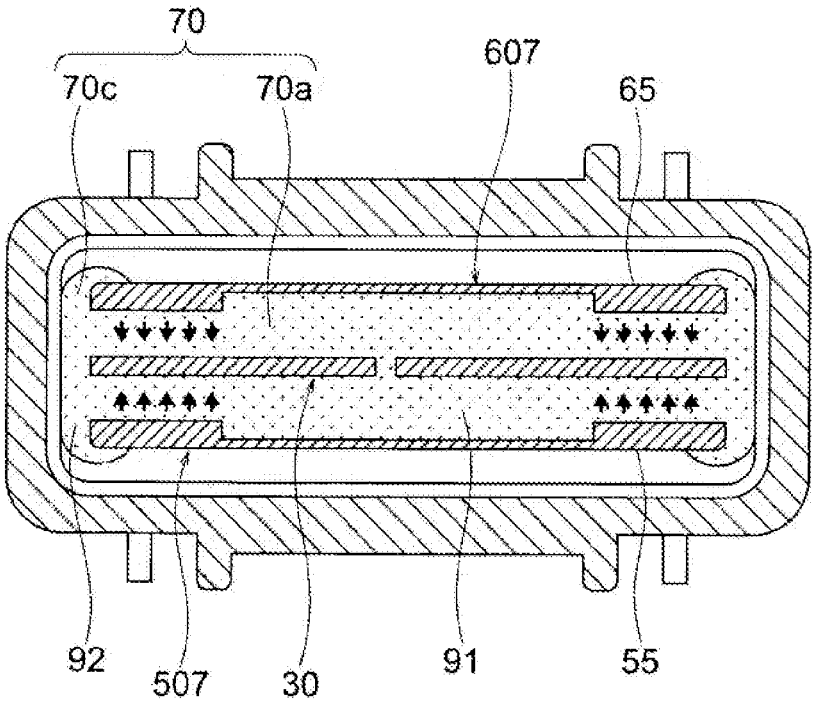
FIG. 19 is a cross-sectional view illustrating a first seal member of the modification of the waterproof connector in the embodiment of the invention.

FIGS. 11 to 16 are perspective views illustrating modifications of first and second retainers in this embodiment, FIG. 17 is a cross-sectional view illustrating a modification of the waterproof connector in this embodiment, FIG. 18 is a cross-sectional view of a retainer of the waterproof connector illustrated in FIG. 17, and FIG. 19 is a cross-sectional view illustrating a first seal member of the modification of the waterproof connector in this embodiment.

In this embodiment, the first defective portion 58 has been formed in the first retainer 50 and the second defective portion 68 has been formed in the second retainer 60. However, the first and second defective portions 58 and 68 are not particularly limited, and a defective portion may be formed in at least one of the retainers.

Figure 11:
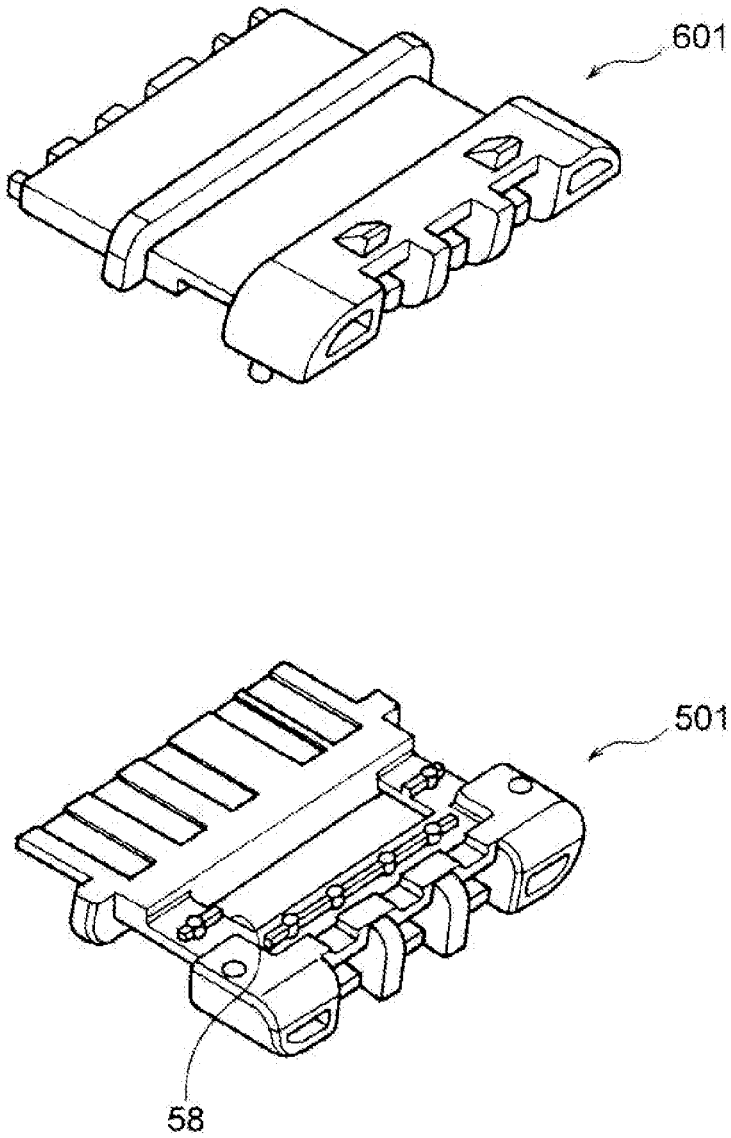
FIG. 11 is a perspective view illustrating a first modification of first and second retainers in the embodiment of the invention.

For example, as illustrated in FIG. 11, a first defective portion 58 may be formed only in a first retainer 501 and a defective portion may not be formed in a second retainer 601. Since the adhesion between the first retainer 501 and a wiring substrate is maintained even in this case, the waterproof performance of the waterproof connector 1 is improved.

Figure 12:
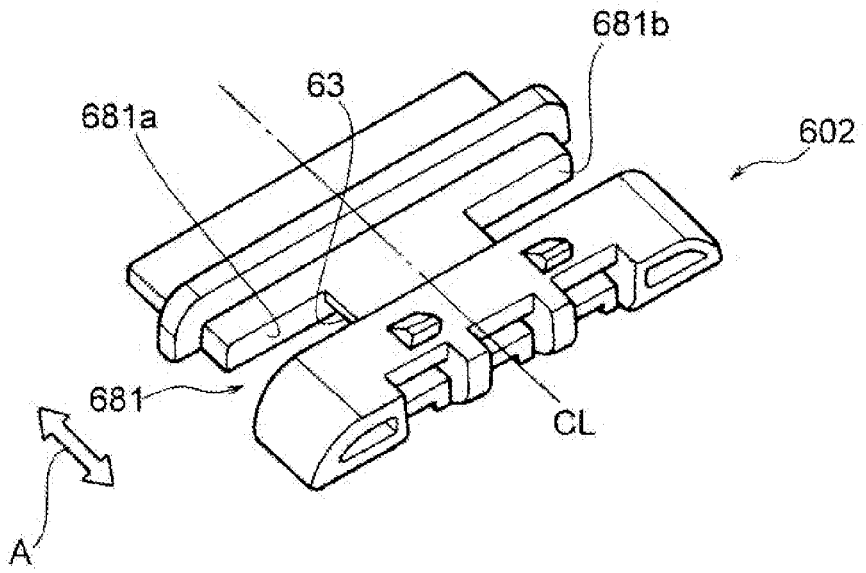
FIG. 12 is a perspective view illustrating a second modification of the first and second retainers in the embodiment of the invention.
Figure 12:
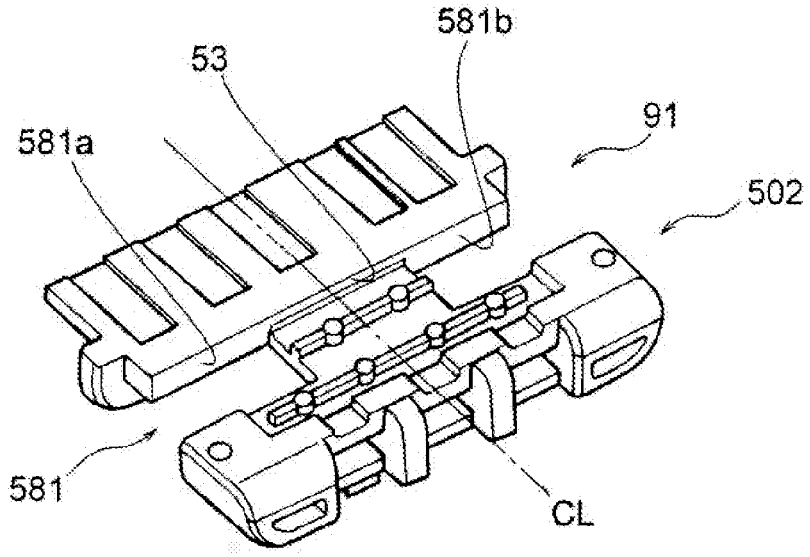

Further, the first and second defective portions 58 and 68 are "openings" in this embodiment, but are not particularly limited. For example, first and second defective portions 581 and 681 of first and second retainers 502 and 602 may be "cutouts" as illustrated in FIG. 12.

As illustrated in the figure, the first defective portion 581 in this case includes first and second cutouts 581*a* and 581*b* that are formed on both ends of the first inner groove 53 so as to have substantially the same size. The second defective portion 681 also includes third and fourth cutouts 681*a* and 681*b* that are formed on both ends of the second inner groove 63 so as to have substantially the same size. Note that, the first cutout 581*a* and the third cutout 681*a* have substantially the same size and face each other. Likewise, the second cutout 581*b* and the fourth cutout 681*b* have substantially the same size and face each other. Note that, the term of "both ends" mentioned here means ends in the direction substantially orthogonal to the inserting/separating direction A of the waterproof connector 1.

In a first seal member of a waterproof connector in which these first and second retainers 502 and 602 are assembled, a side seal portion and a defective seal portion, which is received in the cutouts 581*a*, 581*b*, 681*a*, and 681*b*, are formed integrally. The side seal portion and the defective seal portion, which are formed integrally, reach the outer surface and pull the first and second retainers 502 and 602 toward the inner seal portion.

Meanwhile, since the cutouts 581*a*, 581*b*, 681*a*, and 681*b* are formed in the first and second retainers 502 and 602, the rigidity of the first and second retainers 502 and 602 is low. Accordingly, the first and second retainers 502 and 602 are easily deformed following the shrinkage of the inner seal portion or the defective seal portion.

For this reason, thermal stress generated between the first seal member and the first and second retainers 502 and 602 is reduced, so that the strong sealing between the first seal member and the first and second retainers 502 and 602 is maintained.

Further, since the outer seal portion presses the outer surfaces of the first and second retainers 502 and 602 in addition to the defective seal portion, the thermal stress generated between the first seal member and the first and second retainers 502 and 602 is further reduced.

Furthermore, the first and second defective portions 581 and 681 face each other in the first and second retainers 502 and 602. For this reason, since a wiring substrate is interposed between the first and second retainers 502 and 602 together with the first seal member even in the inner receiving portion 91, it is possible to suppress the occurrence of the distortion or bending of the wiring substrate.

Moreover, the first and second defective portions 581 and 681 of the first and second retainers 502 and 602 are axisymmetric about the center line CL of the inner receiving portion 91 in the inserting/separating direction A of the waterproof connector 1. For this reason, the waterproof connector 1 in this embodiment can receive a force, which is applied when the waterproof connector is inserted or separated, with a good balance and can suppress the deformation of the first and second retainers 502 and 602 when the waterproof connector 1 is inserted or separated.

Figure 13:
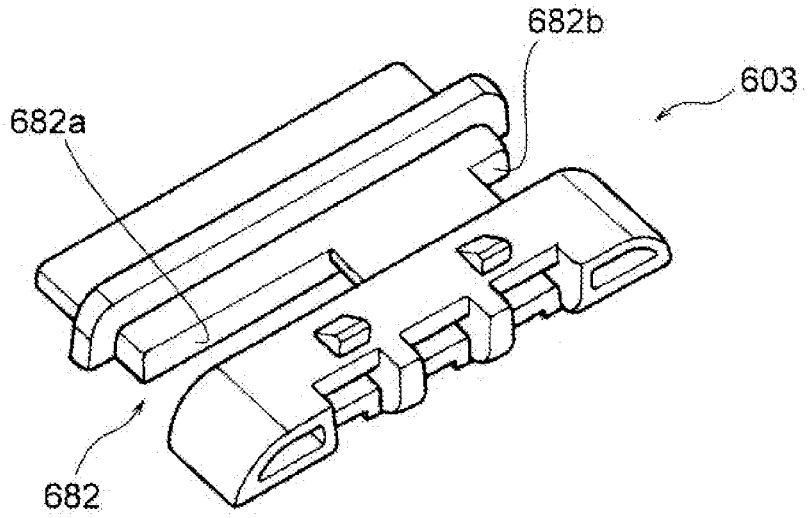
FIG. 13 is a perspective view illustrating a third modification of the first and second retainers in the embodiment of the invention.
Figure 13:
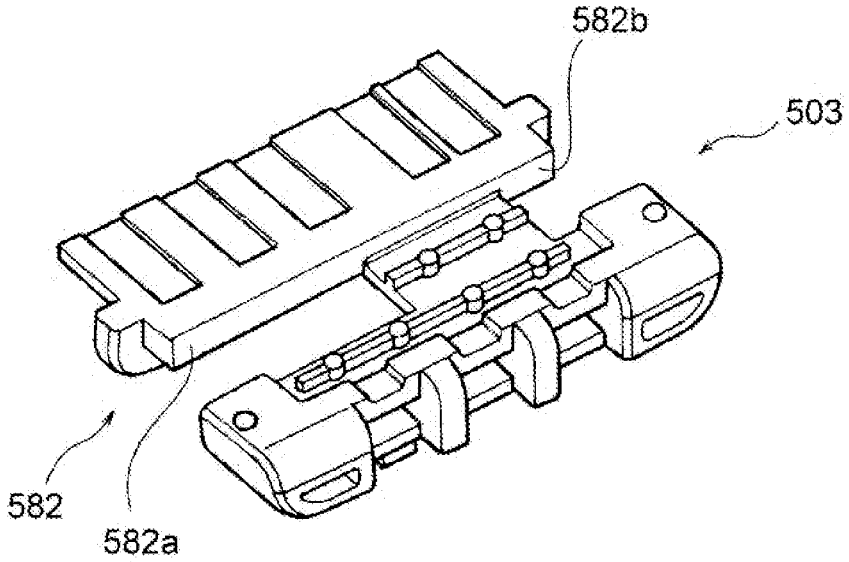

Further, as illustrated in FIG. 13, a first defective portion 582 of a first retainer 503 may include first and second cutouts 582*a* and 682*b* having different sizes. For example, the first cutout 582*a* positioned on the left side in the figure may be formed so as to be relatively large, and the second cutout 582*b* positioned on the right side in the figure may be formed so as to be relatively smaller than the first cutout 582*a*.

Furthermore, as illustrated in the figure, a second defective portion 682 of a second retainer 603 may also include third and fourth cutouts 682*a* and 682*b* having different sizes. For example, the third cutout 682*a* positioned on the left side in the figure may be formed so as to be relatively large and face the first cutout 582*a*, and the fourth cutout 682*b* positioned on the right side in the figure may be formed so as to be relatively small and face the second cutout 582*b*.

The first and second defective portions 582 and 682 of the first and second retainers 503 and 603 face each other. For this reason, since a wiring substrate is interposed between the first and second retainers 503 and 603 together with the first seal member even in the inner receiving portion 91, it is possible to suppress the occurrence of the distortion or bending of the wiring substrate.

Figure 14:
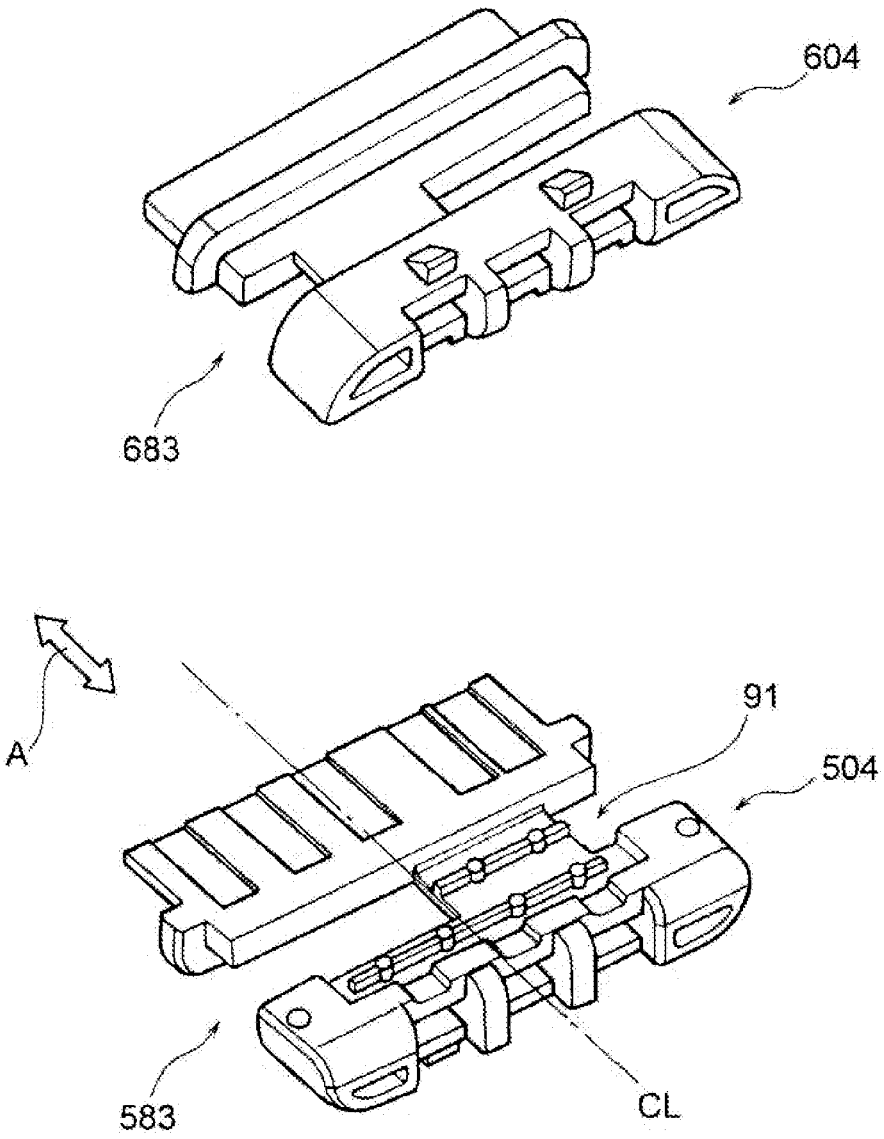
FIG. 14 is a perspective view illustrating a fourth modification of the first and second retainers in the embodiment of the invention.

Moreover, as illustrated in FIG. 14, first and second defective portions 583 and 683 may be formed of cutouts and may be disposed so as to be axisymmetric about the center line CL of the inner receiving portion 91 in the inserting/separating direction A of the waterproof connector 1 when first and second retainers 504 and 604 are combined with each other. Even the first and second retainers 504 and 604 are assembled in the waterproof connector 1, it is possible to improve waterproof performance while suppressing the deformation of the first and second retainers 504 and 604 when the waterproof connector 1 is inserted or separated.

Note that, the first defective portion 583 includes two cutouts and the second defective portion 683 also includes two cutouts in the figure, but the first and second defective portions 583 and 683 are not particularly limited. For example, the first defective portion 583 may include one cutout and the second cutout 683 may also include one cutout.

Further, as illustrated in FIG. 15, a first defective portion 584 may include a first opening 584*a* and first and second cutouts 584*b* and 584*c*. Likewise, a second defective portion 684 may include a second opening 684*a* and third and fourth cutouts 684*b* and 684*c*.

In this case, as illustrated in the figure, in a first retainer 505, the first opening 584*a* is disposed in the middle portion of the first inner groove 53 and the first and second cutouts 584*b* and 584*c* are disposed on both ends of the first inner groove 53. Likewise, even in a second retainer 605, the second opening 684*a* is disposed in the middle portion of the second inner groove 63 and the third and fourth cutouts 684*b* and 684*c* are disposed on both ends of the second inner groove 63. Note that, the "both ends" mentioned here mean ends in the direction substantially orthogonal to the inserting/separating direction A of the waterproof connector 1.

The first and second defective portions 584 and 684 of the first and second retainers 505 and 605 face each other. For this reason, since a wiring substrate is interposed between the first and second retainers 505 and 605 together with the first seal member even in the inner receiving portion, it is possible to suppress the occurrence of the distortion or bending of the wiring substrate.

Furthermore, the first and second defective portions 584 and 684 are axisymmetric about the center line CL of the inner receiving portion 91 in the inserting/separating direction A of the waterproof connector 1. For this reason, even the first and second retainers 505 and 605 are assembled in the waterproof connector 1, it is possible to effectively improve waterproof performance while suppressing the deformation of the first and second retainers 505 and 605 when the waterproof connector 1 is inserted or separated.

Moreover, as illustrated in FIG. 16, first and second defective portions 585 and 685 may include a plurality of circular openings. Even in this case, the plurality of (five in this example) openings that form the first defective portion 585 and the plurality of (five in this example) openings that form the second defective portion 685 are formed so as to be axisymmetric about the center line CL of the inner receiving portion 91 in the inserting/separating direction A of the waterproof connector 1. Further, the plurality of openings that form the first defective portion 584 and the plurality of openings that form the second defective portion 684 are disposed so as to face each other.

Even the first and second retainers 506 and 606 in which the first and second defective portions 585 and 685 are formed are assembled in the waterproof connector 1, it is possible to effectively improve waterproof performance while suppressing the deformation of the first and second retainers 506 and 606 when the waterproof connector 1 is inserted or separated.

Note that, the first and second defective portions 585 and 685 include relatively large openings and relatively small openings in the example illustrated in the figure, but are not particularly limited. The plurality of openings may have the same size. Moreover, the shapes of the openings are also not particularly limited.

In addition, in this embodiment, the first and second defective portions 58 and 68 have been formed in the first and second retainers 50 and 60, respectively, for the improvement of the waterproof performance of the waterproof connector 1. However, the invention is not limited thereto.

For example, as illustrated in FIGS. 17 and 18, instead of the defective portions, a first thin portion 59, which is formed by partially thinning the thickness between a first outer surface 55 and a bottom 91*a* of an inner receiving portion 91, may be formed at a first retainer 507 and a second thin portion 69, which is formed by partially thinning the thickness between a second outer surface 65 and a bottom 91*a* of an inner receiving portion 91, may also be formed at a second retainer 607. Note that, the bottoms 91*a* of the inner receiving portions 91, which are mentioned here, are the bottoms 53*a* and 63*a* of the first and second inner grooves 53 and 63 except for the first and second protrusions or the ribs. Further, a first seal member 70 of this waterproof connector 1A includes an inner seal portion 70*a*, an outer seal portion 70*b*, and a side seal portion 70*c*.

In the waterproof connector 1A in which these first and second retainers 507 and 607 are assembled, the side seal portion 70*c* pulls the first and second retainers 507 and 607 toward the inner seal portion 70*a*. Note that, in this example, the side seal portion 70*c* corresponds to an example of a connecting seal portion of the invention.

In this case, since the first and second thin portions 59 and 69 of the first and second retainers 507 and 607 have relatively low rigidity, the first and second thin portions 59 and 69 are easily deformed following the shrinkage of the first seal member 70. Accordingly, it is possible to maintain the adhesion between the first seal member 70 and the first and second retainers 507 and 607, so that it is possible to improve waterproof performance.

Note that, if the first seal member 70 of the waterproof connector 1A of this example includes the inner seal portion 70*a* and the outer seal portion 70*c* as illustrated in FIG. 19, the above-mentioned effects are obtained. Accordingly, the first seal member 70 does not need to include the outer seal portion 70*b*. However, if the first seal member 70 includes the outer seal portion 70*b*, the following effects are obtained.

That is, since the outer seal portion 70*b* presses the outer surfaces 55 and 65 of the first and second retainers 507 and 607 in addition to the side seal portion 70*c*, the first and second retainers 507 and 607 are more easily deformed following the shrinkage of the first seal member 70. For this reason, it is possible to maintain the strong adhesion between the first seal member 70 and the first and second retainers 507 and 607, so that it is possible to effectively improve waterproof performance.

Note that, the first and second thin portions 59 and 69 have been formed at the first and second retainers 507 and 607 in the example illustrated in the figure, but a thin portion may be formed only on one retainer. For example, the first thin portion 59 is formed only at the first retainer 507, and a thin portion may not be formed at the second retainer 607.

Note that, the above-mentioned embodiment is described to facilitate the understanding of the invention, and does not limit the invention. Accordingly, the respective elements disclosed in the above-mentioned embodiment are to also include all design changes or equivalents that pertain to the scope of the invention.

EXPLANATIONS OF LETTERS OR NUMERALS

1: waterproof connector
10: housing
20: connector body
30: wiring substrate
50, 60: retainer
50*d*, 50*e*, 60*d*, 60*e*: side surface
51, 61: opposite surface

54, 64: protrusion
55, 65: outer surface
56, 66: outer groove
58, 68: defective portion
59, 69: thin portion
70: first seal member
70*a*: inner seal portion
70*b*: outer seal portion
70*c*: side seal portion
70*d*: defective seal portion
80: second seal member
91: inner receiving portion
92: outer receiving portion

The invention claimed is:

1. A waterproof connector which is attached to a wiring substrate, the waterproof connector comprising:

a pair of retainers between which the wiring substrate is interposed and which include an inner receiving portion formed on opposite surfaces which face the wiring substrate; and a first seal member which is made of a hot-melt seal material and is filled in at least the inner receiving portion, wherein an outer receiving portion in which the first seal member is received is formed on outer surfaces and side surfaces among surfaces of the pair of retainers which are along an inserting/separating direction of the waterproof connector, the outer surfaces which are opposite to the opposite surfaces, the side surfaces which cross the opposite surfaces and the outer surfaces, a thin portion, which is formed by partially thinning the thickness between the outer surface and a bottom of the inner receiving portion, is formed in at least one of the retainers, the inner receiving portion communicates with the outer receiving portion at the side surfaces, the first seal member includes:

an inner seal portion which is received in the inner receiving portion; and a connecting seal portion which is received in the outer receiving portion positioned on the side surfaces of the retainers and is formed integrally with the inner seal portion, and the connecting seal portion reaches the outer surfaces of the retainers.

2. The waterproof connector according to claim 1, the waterproof connector further comprising:

a connector body which includes the first seal member and the pair of retainers;

a housing which receives the connector body; and a second seal member which is interposed between the connector body and the housing and seals between the connector body and the housing.

3. A waterproof connector which is attached to a wiring substrate, the waterproof connector comprising:

a pair of retainers between which the wiring substrate is interposed and which include an inner receiving portion formed on opposite surfaces which face the wiring substrate; and a first seal member which is made of a hot-melt seal material and is filled in at least the inner receiving portion, wherein an outer receiving portion in which the first seal member is received is formed on outer surfaces and side surfaces among surfaces of the pair of retainers which are along an inserting/separating direction of the waterproof connector, the outer surfaces which are opposite to the opposite surfaces, the side surfaces which cross the opposite surfaces and the outer surfaces, a defective portion, which passes from the outer surface to the inner receiving portion and in which the first seal member is to be filled, is formed in at least one of the retainers, the inner receiving portion communicates with the outer receiving portion at the side surfaces, the first seal member includes:

an inner seal portion which is received in the inner receiving portion; and a connecting seal portion which is received in the defective portion and the outer receiving portion positioned on the side surfaces of the retainers and is formed integrally with the inner seal portion, the connecting seal portion reaches the outer surfaces of the retainers, the defective portion includes at least one of an opening or a cutout which is formed over the entire overlap between the outer receiving portion and the inner receiving portion in an inserting/separating direction of the waterproof connector, and an area of the defective portion is larger than an area of a portion where the defective portion is not formed in the overlap.

4. The waterproof connector according to claim 3, wherein the defective portion is disposed so as to be axisymmetric about a center line of the inner receiving portion in the inserting/separating direction of the waterproof connector.

5. The waterproof connector according to claim 3, wherein the retainers include a first retainer and a second retainer, the defective portion includes:

a first defective portion which is formed in the first retainer; and a second defective portion which is formed in the second retainer, and the first and second defective portions are disposed so as to face each other.

6. The waterproof connector according to claim 3, the waterproof connector further comprising:

a connector body which includes the first seal member and the pair of retainers;

a housing which receives the connector body; and a second seal member which is interposed between the connector body and the housing and seals between the connector body and the housing.

7. A waterproof connector which is attached to wiring substrates which are disposed adjacent to each other so that a gap is formed between end portions of the wiring substrates, the waterproof connector comprising:

a pair of retainers between which the wiring substrates are interposed and which include an inner receiving portion formed on opposite surfaces which face the wiring substrates; and a first seal member which is made of a hot-melt seal material and is filled in at least the inner receiving portion, wherein an outer receiving portion in which the first seal member is received is formed on outer surfaces and side surfaces among surfaces of the pair of retainers which are along an inserting/separating direction of the waterproof connector, the outer surfaces which are opposite to the opposite surfaces, the side surfaces which cross the opposite surfaces and the outer surfaces, a defective portion, which passes from the outer surface to the inner receiving portion and in which the first seal member is to be filled, is formed in at least one of the retainers, the inner receiving portion communicates with the outer receiving portion at the side surfaces, the defective portion includes at least one of an opening or a cutout, the first seal member includes:

an inner seal portion which is received in the inner receiving portion; and a connecting seal portion which is received in the defective portion and the outer receiving portion positioned on the side surfaces of the retainers and is formed integrally with the inner seal portion, and the connecting seal portion reaches the outer surfaces of the retainers.

8. The waterproof connector according to claim 7, wherein the defective portion is formed over the entire overlap between the outer receiving portion and the inner receiving portion in an inserting/separating direction of the waterproof connector.

9. The waterproof connector according to claim 7, wherein the defective portion is disposed so as to be axisymmetric about a center line of the inner receiving portion in the inserting/separating direction of the waterproof connector.

10. The waterproof connector according to claim 7, wherein the retainers include a first retainer and a second retainer, the defective portion includes:

a first defective portion which is formed in the first retainer; and a second defective portion which is formed in the second retainer, and the first and second defective portions are disposed so as to face each other.

11. The waterproof connector according to claim 7, the waterproof connector further comprising:

a connector body which includes the first seal member and the pair of retainers;

a housing which receives the connector body; and a second seal member which is interposed between the connector body and the housing and seals between the connector body and the housing.

12. The waterproof connector according to claim 5, wherein a first protrusion, which protrudes toward the inside of the inner receiving portion, is formed on the first retainer, a second protrusion, which protrudes toward the inside of the inner receiving portion, is formed on the second retainer, and the first and second protrusions are disposed so as to face each other.

13. The waterproof connector according to claim 10, wherein a first protrusion, which protrudes toward the inside of the inner receiving portion, is formed on the first retainer, a second protrusion, which protrudes toward the inside of the inner receiving portion, is formed on the second retainer, and the first and second protrusions are disposed so as to face each other.

* * * * *